US009868072B2

(12) United States Patent
Ghaly

(10) Patent No.: US 9,868,072 B2
(45) Date of Patent: Jan. 16, 2018

(54) INTERACTIVE PLAY DEVICE AND METHOD

(75) Inventor: Nabil N. Ghaly, South Huntington, NY (US)

(73) Assignee: Interactive Play Devices LLC, Austin, TX (US)

( * ) Notice: Subject to any disclaimer, the term of this patent is extended or adjusted under 35 U.S.C. 154(b) by 272 days.

(21) Appl. No.: 11/294,803

(22) Filed: Dec. 7, 2005

(65) Prior Publication Data

US 2006/0084362 A1 Apr. 20, 2006

Related U.S. Application Data

(60) Continuation of application No. 10/663,616, filed on Sep. 17, 2003, which is a division of application No. 09/611,059, filed on Jul. 6, 2000, now Pat. No. 6,663,393.

(60) Provisional application No. 60/143,236, filed on Jul. 10, 1999.

(51) Int. Cl.

| | |
|---|---|
| ***A63F 9/24*** | (2006.01) |
| ***A63F 13/00*** | (2014.01) |
| ***G06F 17/00*** | (2006.01) |
| ***G06F 19/00*** | (2011.01) |
| ***A63H 29/22*** | (2006.01) |
| ***A63H 3/28*** | (2006.01) |
| ***A63H 33/26*** | (2006.01) |
| *A63H 17/28* | (2006.01) |
| *A63H 17/32* | (2006.01) |

(52) U.S. Cl.

CPC ..... *A63H 29/22* (2013.01); *A63H 3/28* (2013.01); *A63H 33/26* (2013.01); *A63H 17/28* (2013.01); *A63H 17/32* (2013.01); *A63H 2200/00* (2013.01)

(58) Field of Classification Search

CPC ..... A63H 2200/00; A63H 3/28; A63F 13/40; A63F 13/50; A63F 13/06

USPC ..... 463/1, 36–38, 46–47

See application file for complete search history.

(56) References Cited

U.S. PATENT DOCUMENTS 5,832,189 A * 11/1998 Tow ..... G06N 3/008 700/259
6,048,209 A * 4/2000 Bailey ..... 434/267
6,159,101 A * 12/2000 Simpson ..... 463/46
(Continued)

FOREIGN PATENT DOCUMENTS

WO WO 9932203 A1 * 7/1999

*Primary Examiner* — Milap Shah
*Assistant Examiner* — Jason Pinheiro
(74) *Attorney, Agent, or Firm* — John R. Kasha; Kelly L. Kasha; Kasha Law LLC

(57) ABSTRACT

An interactive play device, method and apparatus, is disclosed that includes means for generating a plurality of interactions, input control mechanisms, means for storing responses to interactions, and control means to select the next interaction based on memorized responses. This invention provides a new class of interactive play devices, which is founded on personalizing a play device so that its current functionality is based on how the player has interacted with it in prior playing sessions. The invention also discloses a doll device and a car device, which operate in a plurality of states that mimic human behavior. Further, the specification describes a game during which the player is challenged to transform a play device from an initial state to a desired state by providing appropriate responses to interactions initiated by the device.

35 Claims, 40 Drawing Sheets

(56) References Cited

U.S. PATENT DOCUMENTS 6,160,986 A * 12/2000 Gabai ..... G09B 5/065
434/307 R
6,319,010 B1 * 11/2001 Kikinis ..... 434/169
6,337,552 B1 * 1/2002 Inoue ..... B25J 13/00
318/568.1
6,362,589 B1 * 3/2002 Inoue ..... G05D 1/0088
318/568.1
6,381,515 B1 * 4/2002 Inoue ..... G05B 19/0423
318/800
6,959,166 B1 * 10/2005 Gabai ..... G09B 5/04
434/307 R
6,980,956 B1 * 12/2005 Takagi ..... G06N 3/004
700/250

* cited by examiner

| CONFIDENCE LEVEL | | | | |
|---|---|---|---|---|
| OPERATING STATE | 0 | 1 | 2 | > 2 |
| 1 | NORMAL | NORMAL | NORMAL | NORMAL |
| 2 | NEUTRAL | NORMAL | NORMAL | NORMAL |
| 3 | NEUTRAL | NEUTRAL | NORMAL | NORMAL |
| 4 | NEUTRAL | NEUTRAL | NEUTRAL | NORMAL |

REPLY LEVELS TO ALPHA RESPONSES DURING LEARNING MODE

Figure - 13 -

| CONFIDENCE LEVEL | | | | |
|---|---|---|---|---|
| OPERATING STATE | 0 | 1 | 2 | > 2 |
| 1 | NORMAL | NORMAL | NEUTRAL | LEVEL 1 |
| 2 | NEUTRAL | NEUTRAL | LEVEL 1 | LEVEL 1 |
| 3 | NEUTRAL | LEVEL 1 | LEVEL 1 | LEVEL 2 |
| 4 | NEUTRAL | LEVEL 1 | LEVEL 2 | LEVEL 2 |

REPLY LEVELS TO BETA RESPONSES DURING LEARNING MODE

Figure - 14 -

| CONFIDENCE LEVEL | | | | |
|---|---|---|---|---|
| OPERATING STATE | 0 | 1 | 2 | > 2 |
| 1 | NORMAL | NORMAL | NORMAL | NORMAL |
| 2 | NEUTRAL | NORMAL | NORMAL | NORMAL |
| 3 | NEUTRAL | NEUTRAL | NEUTRAL | NORMAL |
| 4 | NEUTRAL | NEUTRAL | NEUTRAL | NEUTRAL |

REPLY LEVELS FOR ALPHA RESPONSES DURING OPERATING MODE

Figure - 15 -

| CONFIDENCE LEVEL | | | | |
|---|---|---|---|---|
| OPERATING STATE | 0 | 1 | 2 | > 2 |
| 1 | NORMAL | NORMAL | NEUTRAL | LEVEL 1 |
| 2 | NORMAL | NEUTRAL | LEVEL 1 | LEVEL 2 |
| 3 | NEUTRAL | LEVEL 1 | LEVEL 2 | LEVEL 3 |
| 4 | LEVEL 1 | LEVEL 2 | LEVEL 3 | LEVEL 4 |

REPLY LEVELS FOR BETA RESPONSES DURING OPERATING MODE

Figure - 16 -

| TYPICAL PROMPT | NORMAL REPLY |
|---|---|
| Mammy, I am hungry! | Yummy! that tastes so good! |
| Mammy, I want to play. | You are fun Mammy! |
| Mammy, can I have some milk. | I like milk. Its good for me! |
| Mammy, I am scared its too dark. | Thank you Mammy. Stay close to me. |
| Mammy, I am cold. | Mammy you have a magic touch. Its nice and warm now. |
| • Mammy, I can't sleep. | 1. Yawn! I am so sleepy . . . Good night.<br>2. PAUSE, CLOSE EYES<br>3. Snooze Snooze Snooze Snooze<br>4. PAUSE, OPEN EYES<br>5. I had a good sleep. |
| Mammy, I am thirsty. | Thank you . . . I like ice water. |
| Mammy, can you brush my hair. | My hair is long and pretty! |
| Mammy, I cut my finger. | Thank you Mammy. I will be careful next time |
| • Mammy, my feet hurts (or my head hurts, or my back hurts, or my neck hurts, etc.).<br>• (Turn associated LED "ON") | • I feel better Mammy<br>• (Pause then turn LED "OFF") |
| Mammy, I have a bad headache. | Your touch is like magic! |
| Mammy, I don't feel good. | I feel great now! |
| 1. Mammy, I am bored.<br>2. I am done and I am still bored. | 1. OK Mom. This will keep me busy<br>2. Good idea! I will read a long book. |
| Mammy can you tell me a joke! | That's very funny!<br>or<br>Jiggle . . . Jiggle . . . Jiggle<br>or<br>You are the funniest Mom in the whole world. |
| Mammy, I am too hot. | It's nice now! |

NORMAL SPECIFIC REPLIES

Figure - 17 -

| TYPICAL PROMPT | NEUTRAL REPLY |
|---|---|
| Mammy, I am hungry! | Vegetables have a lot of vitamins! |
| Mammy, I want to play. | I have a lot of toys! |
| Mammy, can I have some milk. | I wish if I have my own cow! |
| Mammy, I am scared its too dark. | I don't like scary movies! |
| Mammy, I am cold. | I like summer! |
| Mammy, I can't sleep. | I had a bad dream last night! |
| Mammy, I am thirsty. | I like apple juice better! |
| Mammy, can you brush my hair. | I brush my hair twice a day! |
| Mammy, I cut my finger. | I can't finish my homework now! |
| • Mammy, my feet hurts (or my head hurts, or my back hurts, or my neck hurts, etc.).<br>• (Turn associated LED "ON") | • I should go to a doctor!<br>• (Turn LED "OFF") |
| Mammy, I have a bad headache. | I am studying too much! |
| Mammy, I don't feel good. | May be I have a bug! |
| 1. Mammy, I am bored.<br>2. I am done and I am still bored. | 1. All my friends are busy!<br>2. I wish I have a puppy! |
| Mammy can you tell me a joke! | I like funny movies!<br>or<br>My new teacher is so funny!<br>or<br>I know a lot of jokes! |
| Mammy, I am too hot. | I have a cool idea! |

NEUTRAL SPECIFIC REPLIES

Figure - 18 -

| TYPICAL PROMPT | LEVEL 1 REPLY |
|---|---|
| Mammy, I am hungry! | I am still hungry Mammy! |
| Mammy, I want to play. | Boring! Boring! Boring! |
| Mammy, can I have some milk. | This tastes like medicine! |
| Mammy, I am scared its too dark. | I am really scared now! |
| Mammy, I am cold. | Mammy I am still cold. |
| Mammy, I can't sleep. | My eyes are still open! |
| Mammy, I am thirsty. | Mammy can I have a drink please! |
| Mammy, can you brush my hair. | My hair looks terrible! |
| Mammy, I cut my finger. | Mammy my finger hurts! |
| • Mammy, my feet hurts (or my head hurts, or my back hurts, or my neck hurts, etc.).<br>• (Turn associated LED "ON") | • I am still hurting Mom!<br>• (Flash LED) |
| Mammy, I have a bad headache. | My headache is getting worse! |
| Mammy, I don't feel good. | I feel worse now! |
| 1. Mammy, I am bored.<br>2. I am done and I am still bored. | 1. This will put me to sleep!<br>2. This is no fun!. |
| Mammy can you tell me a joke! | You told me that one before!<br>or<br>You have better jokes than that!<br>or<br>Ha! Ha! Ha! Ha! |
| Mammy, I am too hot. | It's steaming in here! |

LEVEL 1 SPECIFIC REPLIES

Figure - 19 -

| TYPICAL PROMPT | LEVEL 2 REPLY |
|---|---|
| Mammy, I am hungry! | I am starving! |
| Mammy, I want to play. | You don't do anything with me! |
| Mammy, can I have some milk. | This milk is sour! |
| Mammy, I am scared its too dark. | You don't care about me! |
| Mammy, I am cold. | Mammy I am freezing now. |
| Mammy, I can't sleep. | Mammy you forgot your magic touch! |
| Mammy, I am thirsty. | All I am asking for is a glass of water! |
| Mammy, can you brush my hair. | I think I am going to loose my hair! |
| Mammy, I cut my finger. | Mammy I am bleeding now! |
| • Mammy, my feet hurts (or my head hurts, or my back hurts, or my neck hurts, etc.).<br>• (Turn associated LED "ON") | • I have a lot of pain!<br>OR<br>(Crying sound)<br>• (Flash LED) |
| Mammy, I have a bad headache. | You are making me worse! |
| Mammy, I don't feel good. | I feel terrible! |
| 1. Mammy, I am bored.<br>2. I am done and I am still bored. | 1. This will put me to sleep!<br>2. This is no fun!. |
| Mammy can you tell me a joke! | That's not funny!<br>or<br>Is that a joke!<br>or<br>Try again! |
| Mammy, I am too hot. | This heat will make me sick! |

LEVEL 2 SPECIFIC REPLIES

Figure - 20 -

| OPERATING LEVEL | REPLY TO IDENTITY CHECK |
|---|---|
| 1 | • HI MOM<br>• JUST CHECKING MAMMY<br>• I MISSED YOU MOM<br>• I AM ONLY TEASING YOU<br>• I WANT TO PLAY WITH YOU MAMMY |
| 2 | • I AM GLAD YOU STILL HERE<br>• I THOUGHT YOU LEFT<br>• NOW YOU REMEMBER!<br>• DON'T LET ANYBODY ELSE PLAY WITH ME<br>• I MISS YOUR MAGIC TOUCH |
| 3 | • LUCKY GUESS<br>• I STILL HAVE MY DOUBTS<br>• MAY BE YOU SHOULD PLAY LOTTO!<br>• I THINK YOU ARE CHEATING!<br>• THIS IS VERY CONFUSING! |
| 4 | • I BET YOU CAN'T DO THAT AGAIN!<br>• ITS ONLY A START!<br>• YOU HAVE A LONG WAY TO GO!<br>• I MUST BE DREAMING!<br>• I WILL GET TO THE BOTTOM OF THIS |

REPLIES TO POSITIVE IDENTITY CHECK

Figure - 21 -

| OPERATING STATE | TYPICAL REPLIES |
|---|---|
| LEVEL 1<br><br>MAGIC OPERATING STATE | • I LOVE YOU MAMMY!<br>• YOU ARE THE BEST MOM!<br>• I LOVE YOUR MAGIC TOUCH!<br>• MAMMY I LIKE TO PLAY WITH YOU!<br>• I WANT TO HUG YOU MAMMY |
| LEVEL 1<br><br>FUNNY OPERATING STATE | • HI MAMMY BOY!<br>• KNOCK KNOCK KNOK - - - WHO IS THERE?<br>•<br>•<br>•<br>•<br>• |
| NEUTRAL | • NICE WEATHER WE ARE HAVING.<br>• QUE SERA SERA!<br>• NOTHING GOOD ON TV TODAY!<br>• I AM DREAMING OF A WHITE CHRISTMAS!<br>• I HAVE TOO MUCH HOMEWORK!<br>• ALL MY FRIENDS LIKE ME!<br>• I NEED A VACATION! |

GENERAL REPLIES FOR LEVEL 1 & NEUTRAL REPLY LEVELS

Figure -22 -

| OPERATING STATE | TYPICAL REPLIES |
|---|---|
| LEVEL 2<br><br>DOUBT OPERATING STATE | • MAMMY, YOU ARE REALLY ACTING STRANGE TODAY<br>• MOM, ARE YOU FEELING OK?<br>• MAMMY, IS SOMETHING BOTHERING YOU?<br>• MOM, YOU ARE NOT MAKING ANY SENSE<br>• I AM STARTING TO DOUBT YOU.<br>• MOM, YOU SEEM DIFFERENT TODAY<br>• MAMMY, DID YOU FORGET YOUR MAGIC TOUCH?<br>• MOM, WHY ARE YOU FORGETTING THINGS?<br>• YOU KNOW I DON'T TRUST STRANGERS<br>• MOM, CAN YOU PAY ATTENTION TO ME<br>• MAMMY, PLEASE TRY TO REMEMBER YOUR MAGIC TOUCHES<br>• DO YOU WANT ME TO GUESS WHO YOU ARE?<br>• I AM VERY SUSPICIOUS OF YOU<br>• WHERE IS THE MAGIC MAMMY? |
| LEVEL 2<br><br>CONFUSED OPERATING STATE | • MAMMY, YOU ARE CONFUSING ME<br>• MOM, CAN YOU MAKE UP YOUR MIND<br>• I DON'T KNOW WHO YOU ARE ANY MORE<br>• YOU KEEP CHANGING ON ME<br>• I AM REALLY CONFUSED NOW<br>• THIS IS NOT GOING TO BE EASY<br>• I CAN'T FIGURE THIS ONE OUT<br>• MOM, ARE YOU PLAYING A GAME WITH ME<br>• MAMMY, IS THIS A NEW GAME<br>• WHY DO YOU KEEP CHANGING?<br>• ARE YOU TRYING TO CONFUSE ME?<br>• ONLY ONE MAGIC TOUCH MOM<br>• I AM GOING TO FORGET ABOUT THIS ONE<br>• FLIP-FLOP, FLIP-FLOP, FLIP-FLOP, |

GENERAL REPLIES FOR LEVEL 2 REPLY LEVEL

Figure -23 -

| OPERATING STATE | TYPICAL REPLIES |
|---|---|
| LEVEL 3<br><br>ANGRY OPERATING STATE | • DADDY IS GOING TO HEAR ABOUT THIS!<br>• THIS IS VERY UPSETTING!<br>• I DON'T LIKE THIS AT ALL!<br>• THIS IS MAKING ME ANGRY!<br>• I AM VERY ANNOYED!<br>• I AM FED-UP!<br>• I AM NOT AMUSED! |
| LEVEL 3<br><br>SAD OPERATING STATE | • I AM VERY DEPRESSED!<br>• I HAD BETTER DAYS!<br>• CRY CRY CRY CRY<br>• I AM VERY UNHAPPY TODAY!<br>• UNLUCKY ME!<br>• I MISS MY FRIENDS!<br>• I WISH I WAS IN SCHOOL!<br>• NOBODY LOVES ME!<br>• I AM VERY LONELY! |

GENERAL REPLIES FOR LEVEL 3 REPLY LEVEL

Figure -24 -

| OPERATING STATE | TYPICAL REPLIES |
|---|---|
| LEVEL 4<br><br>AGGRESSIVE OPERATING STATE | • HELP HELP TAKE THIS PERSON AWAY!<br>• YOU ARE NOT GOING TO FOOL ME!<br>• I AM GOING TO CAUSE YOU A LOT OF TROUBLE!<br>• NOBODY MESSES UP WITH ME!<br>• YOU SHOULD BE CAREFUL WITH ME! |
| LEVEL 4<br><br>CHALLENGE OPERATING STATE | • YOU ARE NOT MY MAMMY! YOU ARE NOT MY MAMMY!<br>• CRIES. . . I WANT MY MAMMY, I WANT MY MAMMY!<br>• WHO ARE YOU, I THINK YOU ARE AN IMPOSTOR<br>• I AM NOT GOING TO TALK TO YOU ANY MORE<br>• LEAVE ME ALONE . . . YOU ARE NOT MY MAMMY<br>• I KNOW NOW WHY YOU ARE ACTING STRANGE. YOU ARE NOT MY MAMMY!<br>• I DON'T LIKE YOU! |
| LEVEL 4<br><br>FINAL ACT | • I AM GOING TO SLEEP! THIS GAME IS OVER!<br>• I AM NOT GOING TO PLAY WITH YOU ANY MORE!<br>• I HAVE BETTER THINGS TO DO! GOOD BY!<br>• GOOD BY! I AM GOING TO LOOK FOR MY MAMMY! |

GENERAL REPLIES FOR LEVEL 4 REPLY LEVEL

Figure -25 -

REMOTE CONTROL APPARATUS

| CONFIDENCE LEVEL | | | | |
|---|---|---|---|---|
| OPERATING STATE | 0 | 1 | 2 | > 2 |
| 1 | NORMAL | NORMAL | NORMAL | NORMAL |
| 2 | NORMAL | NORMAL | NORMAL | NORMAL |
| 3 | NEUTRAL | NORMAL | NORMAL | NORMAL |
| 4 | NEUTRAL | NEUTRAL | NEUTRAL | NEUTRAL |

REPLY LEVELS TO ALPHA RESPONSES DURING LEARNING MODE

Figure - 31 -

| CONFIDENCE LEVEL | | | | |
|---|---|---|---|---|
| OPERATING STATE | 0 | 1 | 2 | > 2 |
| 1 | NORMAL | NORMAL | NEUTRAL | LEVEL 1 |
| 2 | NEUTRAL | NEUTRAL | LEVEL 1 | LEVEL 1 |
| 3 | NEUTRAL | LEVEL 1 | LEVEL 1 | LEVEL 2 |
| 4 | NEUTRAL | LEVEL 1 | LEVEL 2 | LEVEL 2 |

REPLY LEVELS TO BETA RESPONSES DURING LEARNING MODE

Figure - 32 -

| | CONFIDENCE LEVEL | | | |
|---|---|---|---|---|
| OPERATING STATE | 0 | 1 | 2 | > 2 |
| 1 | NORMAL | NORMAL | NORMAL | NORMAL |
| 2 | NEUTRAL | NORMAL | NORMAL | NORMAL |
| 3 | NEUTRAL | NEUTRAL | NEUTRAL | NORMAL |
| 4 | NEUTRAL | NEUTRAL | NEUTRAL | NEUTRAL |

REPLY LEVELS FOR ALPHA RESPONSES DURING OPERATING MODE

Figure - 33 -

| | CONFIDENCE LEVEL | | | |
|---|---|---|---|---|
| OPERATING STATE | 0 | 1 | 2 | > 2 |
| 1 | NORMAL | NORMAL | NEUTRAL | LEVEL 1 |
| 2 | NORMAL | NEUTRAL | LEVEL 1 | LEVEL 2 |
| 3 | NEUTRAL | LEVEL 1 | LEVEL 2 | LEVEL 3 |
| 4 | LEVEL 1 | LEVEL 2 | LEVEL 3 | LEVEL 4 |

REPLY LEVELS FOR BETA RESPONSES DURING OPERATING MODE

Figure - 34 -

| CONFIDENCE LEVEL OF LAST RESPONSE | | | | |
|---|---|---|---|---|
| OPERATING STATE | 0 | 1 | 2 | > 2 |
| 1 | LOYAL | LOYAL | LOYAL | LOYAL |
| 2 | LOYAL | LOYAL | LOYAL | LOYAL |
| 3 | 20% IND.<br>80% LOYAL | LOYAL | LOYAL | LOYAL |
| 4 | 50% IND<br>50% LOYAL | 40% IND.<br>60% LOYAL | 30% IND.<br>70% LOYAL | 20% IND<br>80% LOYAL |

CATEGORY OF MOTION RESPONSE DURING LEARNING MODE (LAST RESPONSE IS ALPHA)

Figure - 35 -

| CONFIDENCE LEVEL OF LAST RESPONSE | | | | |
|---|---|---|---|---|
| OPERATING STATE | 0 | 1 | 2 | > 2 |
| 1 | LOYAL | LOYAL | 20% IND<br>80% LOYAL | 50% LOYAL<br>50% IND. |
| 2 | LOYAL | 20% IND<br>80% LOYAL | 50% IND<br>50% LOYAL | INDEPENDT. |
| 3 | 20% IND.<br>80% LOYAL | 50% IND<br>50% LOYAL | INDEPENDT. | 20% DEFIANT<br>80% IND. |
| 4 | 50% IND.<br>50% LOYAL | 80% IND<br>20% LOYAL | 20% DEFIANT<br>80% IND. | 50% DEFIANT<br>50% IND |

CATEGORY OF MOTION RESPONSE DURING LEARNING MODE (LAST RESPONSE IS BETA)

Figure - 36 -

| CONFIDENCE LEVEL OF LAST RESPONSE | | | | |
|---|---|---|---|---|
| OPERATING STATE | 0 | 1 | 2 | > 2 |
| 1 | LOYAL | LOYAL | LOYAL | LOYAL |
| 2 | LOYAL | LOYAL | LOYAL | LOYAL |
| 3 | 20% IND.<br>80% LOYAL | LOYAL | LOYAL | LOYAL |
| 4 | 50% IND<br>50% LOYAL | 40% IND.<br>60% LOYAL | 30% IND.<br>70% LOYAL | 20% IND<br>80% LOYAL |

CATEGORY OF MOTION RESPONSE DURING OPERATING MODE (LAST RESPONSE IS ALPHA)

Figure - 37 -

| CONFIDENCE LEVEL OF LAST RESPONSE | | | | |
|---|---|---|---|---|
| OPERATING STATE | 0 | 1 | 2 | > 2 |
| 1 | LOYAL | LOYAL | 20% IND<br>80% LOYAL | 50% LOYAL<br>50% IND. |
| 2 | LOYAL | 50% IND<br>50% LOYAL | 80% IND<br>20% LOYAL | 80% IND.<br>20% DEFIANT |
| 3 | 20% IND.<br>80% LOYAL | 80% IND<br>20% LOYAL | 20% DEFIANT<br>80% IND | 80% DEFIANT<br>20% IND. |
| 4 | 50% IND.<br>50% LOYAL | 50% IND<br>50% DEFIANT | 50% DEFIANT<br>50% IND. | DEFIANT |

CATEGORY OF MOTION RESPONSE DURING OPERATING MODE (LAST RESPONSE IS BETA)

Figure - 38 -

| TYPICAL PROMPT | SPECIFIC MECHGANICAL REPLY | NORMAL REPLY |
|---|---|---|
| My engine is hot Master. I need a cold refill! | None | My temperature is back to normal! |
| What a lazy engine! I have to feed it some oil! | None | Smoooth running!!! |
| Master. We are going to run out of gas. I have less than two gallons left! | None | Ready to go. Full speed ahead! |
| I need a boost! my battery is dying master! | None | Zoop! I am in over charge! |
| Oh No! Flat tire! | None | Good air pressure! |

NORMAL SPECIFIC REPLIES

Figure - 39 -

| TYPICAL PROMPT | SPECIFIC MECHANICAL REPLY | NEUTRAL REPLY |
|---|---|---|
| My engine is hot Master. I need a cold refill! | Disable movement for 15 seconds | May be we should rest for a while! |
| What a lazy engine! I have to feed it some oil! | Limit maximum speed to one half for 30 seconds | Slow and easy will do it! |
| Master. We are going to run out of gas. I have less than two gallons left! | Normal for 15 seconds then disable movement for 30 seconds | Good to the last drop! |
| I need a boost! my battery is dying master! | Choppy movement for thirty seconds then disable movement for one minute | Its only a matter of time! |
| Oh No! Flat tire! | Normal motion with ticking noise for next 30 seconds of forward or backward movement. | My shocks are taking a beating! |

NEUTRAL SPECIFIC REPLIES

Figure - 40 -

| TYPICAL PROMPT | SPECIFIC MECHANICAL REPLY | LEVEL 1 REPLY |
|---|---|---|
| My engine is hot Master. I need a cold refill! | Disable movement for 30 seconds | Master. You should read the instruction manual! |
| What a lazy engine! I have to feed it some oil! | Limit maximum speed to one third for 30 seconds | Do you know how much a new engine would cost?! |
| Master.. We are going to run out of gas. I have less than two gallons left! | Normal for 30 seconds then disable movement for one minute | I told you we are going to get stuck! (*repeat*) |
| I need a boost! my battery is dying master! | Choppy movement for thirty seconds then disable movement for thirty seconds | I have no lights. I can't even ask for help! |
| Oh No! Flat tire! | Normal motion with ticking noise for next minute of forward or backward movement. | You know this is your fault. I told you to put air in the tire! (*repeat*) |

LEVEL 1 SPECIFIC REPLIES

Figure - 41 -

| TYPICAL PROMPT | SPECIFIC MECHANICAL REPLY | LEVEL II REPLY |
|---|---|---|
| My engine is hot Master. I need a cold refill! | Disable movement for 30 seconds | Obviously you don't care! |
| What a lazy engine! I have to feed it some oil! | Limit maximum speed to one third for one minute | I don't know how you got your liscence to drive! |
| Master. We are going to run out of gas. I have less than two gallons left! | Normal for 30 seconds then disable movement for one minute | Totally irresponsible! Our mission is going to fail! |
| I need a boost! my battery is dying master! | Choppy movement for thirty seconds then disable movement for one minute | Mission control is going to hear about this one! |
| Oh No! Flat tire! | Normal motion with ticking noise for next minute of forward or backward movement. | Can't you do any thing right! |

LEVEL II SPECIFIC REPLIES

Figure - 42 -

| MOTION COMMAND | MECHANICAL RESPONSE | VERBAL RESPONSE |
|---|---|---|
| Idle | Free wheeling or stay still | *Repeat every 30 seconds*<br>• I am ready master!<br>• Ready to go!<br>• Whenever you ready!<br>• Any time you want! |
| Forward | Move forward - 3 seconds delayed action | *Response upon activation*<br>• Ready, steady, go!<br>• Moving forward!<br>• Straight ahead! |
| Backward | Move backward - 3 seconds delayed action | *Response upon activation*<br>• Going backward!<br>• All clear! |
| Turn left | Make left turn | • Turning to the left! |
| Turn Right | Make right turn | • Turning to the right! |
| Increase speed | Increase speed | • Full speed ahead! |
| Decrease speed | Decrease speed | • Slowly does it! |

BEHAVIORAL RESPONSE TO MOTION COMMANDS (LOYAL)

Figure - 43 -

| MOTION COMMAND | MECHANICAL RESPONSE | VERBAL RESPONSE |
|---|---|---|
| Idle | *Repeat at random every 30 seconds:*<br>• Move forward for 5 seconds<br>• Move backward for 5 seconds<br>• Move in circle for 5 seconds | *Select at random. Repeat every 30 seconds*<br>• I got to move around!<br>• You can't catch me!<br>• I can drive too!<br>• I am not going to wait for you! |
| Forward | Move reverse - 3 seconds delayed action | *Select at random. Repeat every 5 seconds. Respond upon activation:*<br>• I am not moving forward!<br>• Ha . . . Ha!<br>• I can go any place I want to! |
| Backward | Move backward - 3 seconds delayed action | *Response upon activation*<br>• Going backward!<br>• All clear! |
| Turn left | Make left turn | • Turning to the left! |
| Turn Right | Make right turn | • Turning to the right! |
| Increase speed | Increase speed | • Full speed ahead! |
| Decrease speed | Decrease speed | • Slowly does it! |

BEHAVIORAL RESPONSE TO MOTION COMMANDS (DEFIANT)

Figure - 44 -

| MOTION COMMAND | MECHANICAL RESPONSE | VERBAL RESPONSE |
|---|---|---|
| Idle | Free wheeling or stay still | *Repeat every 30 seconds*<br>• I am ready master!<br>• Ready to go!<br>• Whenever you ready!<br>• Any time you want! |
| Forward | Move forward - 3 seconds delayed action | *Response upon activation*<br>• Ready, steady, go!<br>• Moving forward!<br>• Straight ahead! |
| Backward | Move backward - 3 seconds delayed action | *Response upon activation*<br>• Going backward!<br>• All clear! |
| Turn left | Make left turn | • Turning to the left! |
| Turn Right | Make right turn | • Turning to the right! |
| Increase speed | Increase speed | • Full speed ahead! |
| Decrease speed | Decrease speed | • Slowly does it! |

BEHAVIORAL RESPONSE TO MOTION COMMANDS (INDEPENDENT)

Figure - 45 -

Background:

- Doll # 1 Mood: Joyful
- Doll # 2 Mood: Confused

Interaction:

- Doll # 1: Hello!
- Doll # 2: Hi!
- Doll # 1: How are you?
- Doll # 2: I am totally confused - - - My Mammy keeps changing her mind --- I don't know what's what any more!
- Doll # 1: I am so happy --- I am having such a wonderful time with Mom --- My mammy is my best friend!
- Etc., ---

Figure – 47 -

Background:

- Car # 1 Mood: Playful
- Car # 2 Mood: Defiant

Interaction:

- Car # 1: Hi Buddy!
- Car # 2: Hi!
- Car # 1: How is it going?
- Car # 2: Its going! – I have had it! – I am not following orders any more! – My driver can't get any thing right! – Yesterday, I traveled five miles with a flat tire. – I Quit!!
- Car # 1: I am having fun! – My driver keeps me in top shape! – We play a lot of games together! – Take it easy!!
- Etc., ---

Figure – 48 -

INTERACTIVE PLAY DEVICE AND METHOD

PARENT CASE TEXT

This is a continuation application of patent application, U.S. Ser. No. 10/663,616, filed in the Patent Office on Sep. 17, 2003, which is a divisional application of U.S. Ser. No. 09/611,059 filed in the Patent Office on Jul. 6, 2000, now issued as U.S. Pat. No. 6,663,393 240, which benefits from provisional application of U.S. Ser. No. 60/143,236, file on Jul. 10, 1999. All of the patent applications identified in this paragraph are incorporated by reference herein in their entirety.

BACKGROUND OF THE INVETION

Play and toy devices come in many forms and shapes and are normally a miniaturization of real life settings portraying people, animals or objects. Toys are, also, classified into many categories such as dolls, action figures, motorized devices, remote controlled cars, construction sets, etc. One mutual element in all of these play and toy devices, and especially in active and interactive toys, such as motorized, electrically operated or voice activated toys, is the common characteristic that the action or functionality of a specific toy device is predetermined, fixed and/or anticipated for each and every play session of any unit of the device. A toy device usually functions in a predefined manner every time the toy is activated and, although some toy devices retain or memorize the status or stage of a game at the time when they are turned "off", and other devices may incorporate random elements to change the functionality of the toy, these devices do not retain any information on how players had interacted with them during prior playing sessions. In addition, all units of a mass produced toy device usually respond in an identical and predictable manner to a specific control or a plurality of controls independent of how players had interacted with them.

One example of interactive toys is action or talkative dolls. Dolls represent a major sector of the toy market and, as such, they have been around longer than any other toy class. As the micro-electronic technology becomes more cost effective relative to the consumer market, the development and manufacturing of action dolls that incorporate speech as well as mechanical and electronic components becomes feasible for mass production. There are a wide variety of dolls, which provide a life-like response some of them appear to respond to external stimuli. U.S. Pat. No. 5,281,143 which was issued on Jan. 25, 1994, to Arad et al. describes a learning doll. The patent specifications disclose a doll, which is apparently capable of learning speech in response to human voice and touch interaction. Such learning, however, is a simulated learning and is limited to speech generation. In addition, the arrangement for apparent learning is such that the doll requires a combination of human speech and touch interaction for its operation.

OBJECT OF THE INVENTION

This invention relates to play devices and toys and in particular to a new class of interactive toys which is founded on personalizing a play device so that its current functionality is based on past interactions with a player rather than providing an identical operation or a randomly activated function each time the device is turned "on." Since different players may interact in various ways with the same toy device, over a period of time, the operation of a specific toy device can be made to vary from that of an identical device depending on said past interactions. In effect, such play devices can be personalized to each player and can gradually and systematically adapt their operations to the way players are interacting with them. Accordingly, one object of this invention is to provide new play devices which performance is affected by previous interactions or operations.

It is another object of this invention to provide new toy devices that can operate in a plurality of modes, including a "learning" mode in which a device can gain "knowledge" in connection with how a player is interacting with the device and how the player had responded to a particular subject matter or situation, in previous playing sessions.

A further object of the invention is to provide new toy devices capable of actual learning in response to repeated and/or sequential interactions with a player through entry control means.

It is yet another object of the current invention to provide a plurality of toy devices that incorporate a confidence level for each knowledge gained in connection with a particular subject matter or in response to specific situations.

It is, also, an object of this invention to provide toy devices which operate in a plurality of states that mimic human behavior.

It is another object of this invention to provide play devices with a plurality of games including a game that would challenge the player to transition the play device from an initial state to a desired state.

It is a further object of this invention to provide play devices that function in a sequence of acts or scenes, which include two-way interactions with a player.

Yet another object of this invention is to provide toy devices that recognize patterns of antonym responses to specific topics or situations based on previous interactions. These responses could be classified into two, three or more categories. Said antonym responses could be classified as familiar/odd, good/bad, right/wrong, true/false, smart/stupid, clever/flimsy or the like.

It is yet another object of this invention to provide a plurality of sound effects in the form of verbalization of comments or thoughts associated with a specific act or scene and/or melodies to heighten the enjoyment of play.

It is, also, an object of this invention to provide toy devices which initiate random events or acts that depict real life situations with anticipated antonym responses that can be either familiar/odd, good/bad, true/false, right/wrong, smart/stupid, clever/flimsy or the like.

It is another object of this invention to provide examples of such new play devices as preferred and alternate embodiments.

It is yet another object of this invention to provide a new talkative action doll that initiates a sequence of interactions, which include prompting requests in vocalized and/or visual format.

It is, also, an object of the current invention to provide a new doll that comprises entry control means for a player to interact with it.

It is still an object of the current invention to provide a new doll that interacts with a similar doll using infrared technology.

It is also an object of the invention to provide a new doll that allows a player to interact with it by activating, plugging in and/or connecting a plurality of accessories to the doll device.

It is further an object of this invention to provide new doll that interacts with the player in human like moods.

It is yet another object of this invention to provide a new doll device that challenges the player to transform its mood from a first mood to a second mood.

Yet another object of the current invention is to provide a new toy car with or without a remote control, and that incorporates speech and initiates a sequence of interactions that include requests in vocalized, visual, and/or movement formats.

It is, also, an object of this invention to provide a new toy car, which comprises additional entry control means for the player to interact with the car.

It is further an object of this invention to provide a new toy car device that operates in human like moods.

It is still an object of this invention to provide a new toy car device that defies movement commands by the player.

It is also an object of this invention to provide a new toy car device that interacts with a similar device using infrared technology.

It is yet another object of this invention to provide a new toy car device that challenges the player to transform its mood from a first mood to a second mood.

It is a further object of the invention to achieve the above objectives in an economical and easy to implement fashion.

SUMMARY OF THE INVETION

The foregoing and other objects of the invention are achieved in accordance with one preferred embodiment of the invention by providing a doll that comprises a microprocessor, a plurality of magnetic sensors that can be activated by a permanent magnet when said magnet is moved to a close proximity to a sensor, means for generating verbalized sentences and other sound effects and a plurality of electromechanical devices which provide human like effects such as eye and lip movements and means to provide a plurality of visual effects such as changes to skin color. The magnetic sensors will serve as entry control means and will be activated by a "magic" baton, which incorporates, at one end, a permanent magnet housed in a compartment shaped as a star. In a variation to the combination of magnetic sensors and permanent magnet, the player may interact with the doll device using a baton that incorporates a plurality of switches and an infrared transmitter to communicate with the doll. In such case the doll incorporates an infrared module to receive information from the baton as to which of said plurality of switches was activated by the player.

The doll functions by generating a sequence of verbalized requests, comments and/or statements in accordance with a predefined script. A script is based on a specific need, act or real life situation. Some of these requests, comments and/or statements require a response through the activation of any of the magnetic sensors, which are located at "magic" spots on the doll. As a player interacts with the doll by touching the "magic" baton to a "magic" spot of his or her choice, the microprocessor will memorize that spot as this player's response to the specific need, act or situation. In the alternative, and when an infrared baton is used, the player interacts with the doll by activating any of the switches on the baton. The microprocessor will then memorize the location of the activated switch as the player's response to the specific need, act or situation. Other variations to entry control means include a plurality of accessories that can be connected to the doll in response to a specific need. For example, if the doll needs food, the player may plug into the doll one of a plurality of food accessories provided with the doll device. Each of said food accessories can be sensed and recognized by the doll. Other accessories such as drinks, clothing, makeup kits, books, toys, pets, hobbies, or the like, can also be plugged or connected to the doll device. Further, some accessories may include control means that can be activated by the player and sensed by the doll device. For example, an accessory that depicts milk can be controlled by the player to provide cold, warm or hot milk. For each of the categories of accessories, a plurality of items is provided. The doll device will recognize each item in each of the various categories using either mechanical or magnetic sensors or the like.

In the case of a doll, the player will most likely be a child. The act of touching the baton to a specific spot, or activating a switch on the baton, is called the "magic touch." In the alternative, and when accessories are used, the act of connecting an accessory to the doll device is called "magic play." The mode in which the doll memorizes a response is called the learning mode. During the learning mode, the doll gains actual knowledge with respect to the way a child reacts or responds to various needs, acts or situations. A child is instructed, as part of the play rules, to be consistent in his or her choice of response to a specific need, act or situation. Through repeated play, the doll may gain or loose confidence in a particular knowledge dependent on the uniformity of the responses. Accordingly, in the learning mode, the microprocessor is mainly programmed to establish a knowledge database with confidence levels.

Conversely, in the acting mode the doll uses its information knowledge data base to execute or perform a sequence of acts. Each act is designed to include one or more scripts to be selected partially based on the type of response received by the doll. Responses for this doll device are classified into three main categories: "familiar", "odd" or "no response." The microprocessor is programmed to answer with specific and/or general replies, in a plurality of human-like moods, to these responses. The moods are selected either at random or based on a predefined algorithm. Random selection is normally between homogeneous states, which are predefined as possible replies to a singular class of responses within the same operating level. The selection between the learning and operating modes is done at random. However, such random selection is, also, controlled by the total level of knowledge the doll has gained to date. The acts and scripts in this preferred embodiment are designed to depict the doll as a child addressing the player as her "mom" or "mammy." A typical operating state that is normally selected when a player, who is not familiar with the response history, attempts to play with the doll and interacts with it in a non-familiar or "odd" way is the "challenge" operating state. During the execution of this state, a script may be initiated in which the doll challenges the player with verbalized statements that he or she is not her mom.

To further personalize each doll, and during learning modes, the player is requested to identify a secret "magic spot" and to respond to questions related to personal preferences. If accessories are used, the player is requested to identify a special item in a category as a favorite personal item that bonds the player to the doll device. The doll device uses the "critical knowledge" gained from these questions, together with either the secret magic spot or the special accessory item, to check the identity of the player during game play.

To heighten the enjoyment of play, human-like effects such as eye and lips movements and skin color changes may be provided. Eye and lips movements are implemented using an electromechanical device controlled by the microprocessor. The skin color effects are implemented using a plurality of LED's in various colors located inside the doll and controlled by the microprocessor.

To incorporate doll-to-doll interaction, an infrared communication device is used. Under such feature, and when two dolls are placed at close proximity to each other, the dolls would interact with each other in the form of a conversation related to their current moods. Accordingly, and if we assume that there is a total of (n) possible moods per doll, then there is a potential for ($n^2$) possible different interactions that may take place. Additional doll-to-doll interactions are possible based on the last five specific interactions with each player. The script for each interaction is stored within the memory of each doll device, and all that is required is for one doll to transmit its mood to the other doll for the interaction to take place. Upon completion of a sentence that is part of a script, the doll will transmit a signal to the other doll to start its response or reply.

The foregoing objects of the invention can also be achieved in accordance with an alternate embodiment of the invention by providing a toy car, with or without a remote control, that comprises, in addition to the usual components, a micro-processor, a plurality of additional entry control means, navigation means and means for generating verbalized sentences and other sound effects. The additional entry control means are implemented using switches located either on the remote control apparatus or on the car body. Upon the activation of any of these switches, a signal will be transmitted to the microprocessor of the car apparatus identifying which switch was activated. The navigation means will be controlled by the microprocessor and will in turn control steering, speed and motion direction of the toy car. To navigate the car apparatus, the microprocessor will generate direction, speed and steering commands.

The toy car functions by generating a sequence of verbalized requests, comments and/or statements in accordance with predefined scripts. A script may be based on a specific necessity an actual car must have to operate. For example, an actual car needs fuel or energy for motion, oil for lubrication, water for cooling, a battery for electrical energy, etc. A script can, also, be based on a fictitious adventure or action the car may be engaging in, together with the player, as a team. Some of these requests, comments and/or statements require a response through the activation of any of the switches located either on the remote control apparatus or on the car body. These responses depict the player's skill in handling a situation or a request set forth by the car. These switches are marked, for identification by the player, either by color or through the use of labels. As a player interacts with the car by activating a switch of his or her choice, the microprocessor memorizes the location of that switch as this player's response to the specific necessity, act or situation. In the case of a remote control car, the player will most likely be a child. The act of activating a switch is called the "incredible skill" The mode in which the car memorizes a response is called the learning mode. During the learning mode, the car gains knowledge with respect to the child's skills as he or she reacts or responds to various necessities, acts or situations. A child is instructed, as part of the play rules, to be consistent in his or her choice of response to a specific necessity, act or situation. Through repeated play, the car may gain or loose confidence in a particular knowledge dependent on the uniformity of the responses. Accordingly, in the learning mode, the microprocessor is mainly programmed to establish a knowledge database with confidence levels.

Conversely, in the acting mode the car uses its information knowledge stored in the database to execute or perform an act. Each act is designed to include one or more scripts to be selected partially based on the type of response received from the player. Responses for this car device are classified into three main categories: "clever", "flimsy" or "no response." The microprocessor is programmed to reply in different states to these responses. The states are selected either at random or based on a predefined algorithm. Random selection is normally between homogeneous states, which are predefined as possible replies to a singular class of responses within the same operating level. The selection between the learning and operating modes is done at random. However, such random selection is dependent on the total level of knowledge the car has gained to date. The acts and scripts in this alternate embodiment are designed to depict the car as an android addressing the player as his or her master. During the learning mode, the player demonstrates his or her skills in response to various needs, requests or situations. The operating states are such that a player remains in control of the android as long as he or she continues to interact in a consistent way with the car. As soon as a player deviates from the clever response memorized by the android, he or she will experience a loss of control of the car. A typical operating state that is normally selected when a player, who is not familiar with the response history, attempts to play with the car and interacts with it in a "flimsy" way is the "rejection" operating state. During the execution of this operating state, a script may be initiated in which the car rejects the player with verbalized statements that he or she is not its master. The car will then navigate itself, under the control of the microprocessor, and independent of any mechanical commands received from the player.

It should be noted that, similar to the case of the doll device, a plurality of accessories in various categories may be used by the player to respond to the car needs. These accessories can be activated, plugged into, or connected to the car device, and may be used in lieu of the switches by the player. In such case, the car device will sense and recognize each item in each category, and will remember specific items plugged or connected by the player in response to specific acts or needs.

To further personalize each car, and during learning modes, the player is requested to identify a secret switch, a special item in a category, and/or to respond to questions related to personal preferences. The knowledge gained from these questions is called "critical knowledge" and may be used by the android, together with the secret switch or the special item, to check the identity of the player.

To implement car-to-car interaction, an infrared communication module must be incorporated into the motorized toy car. Such infrared module can serve two purposes; it can provide the remote control functions for the car device as an alternate to the shown radio control module. In addition, the infrared module will provide for car-to-car interaction. Under such feature, and when two cars are placed at close proximity to each other, the cars will interact with each other in the form of a conversation and/or movements related to their current moods. Accordingly, and similar to the doll device, and if we assume that there is a total of (n) possible moods per car, then there is a potential for ($n^2$) possible different interactions that may take place between the two cars. Additional car-to-car interactions are possible based on the last five specific interactions with each player. The script for each interaction is stored within the memory of each car device, and all that is required is for one car to transmit its mood to the other car for the interaction to take place. Upon completion of a sentence or an action that is part of a script, the car will transmit a signal to the other car to start its response or reply.

BRIEF DESCRIPTION OF THE DRAWINGS

The foregoing summary, as well as the following detailed descriptions of the preferred and alternate embodiments of the invention, will be better understood when in conjunction with the appended drawings, it being understood, however, that this invention is not limited to the precise arrangements illustrated in the accompanying drawings:

FIGS. 13-16 are tabulations of proposed reply levels as a function of operating state, confidence level, operating mode and type of response;

FIG. 17 is a tabulation of proposed prompts and corresponding Normal specific replies for the doll play device;

FIG. 18 is a tabulation of proposed prompts and corresponding Neutral specific replies for the doll play device;

FIG. 19 is a tabulation of proposed prompts and corresponding Level 1specific replies for the doll play device;

FIG. 20 is a tabulation of proposed prompts and corresponding Level 2 specific replies for the doll play device;

FIG. 21 is a tabulation of proposed replies to Positive Identity Check for the doll play device;

FIG. 22 is a tabulation of proposed General Replies for Level 1 and Neutral reply levels;

FIG. 23 is a tabulation of proposed General Replies for Level 2 reply level;

FIG. 24 is a tabulation of proposed General Replies for Level 3 reply level;

FIG. 25 is a tabulation of proposed General Replies for Level 4 reply level;

FIGS. 31-34 are tabulations of proposed reply levels as a function of operating state, confidence level, operating mode and type of response;

FIGS. 35-38 are tabulations of proposed categories of motion responses during various modes as a function of operating state, confidence level, and type of last response;

FIG. 39 is a tabulation of Normal specific replies for the car play device;

FIG. 40 is a tabulation of Neutral specific replies for the car play device;

FIG. 41 is a tabulation of Level 1 specific replies for the car play device;

FIG. 42 is a tabulation of Level 2 specific replies for the car play device;

FIG. 43 is a tabulation of proposed Loyal behavioral responses to motion commands;

FIG. 44 is a tabulation of proposed Defiant behavioral responses to motion commands;

FIG. 45 is a tabulation of proposed Independent behavioral responses to motion commands;

FIG. 47 shows examples of doll-to-doll interactions; and

FIG. 48 shows examples of car-to-car interactions.

DETAILED DESCRIPTION OF THE PREFERRED EMBODIMENT

Figure 1:
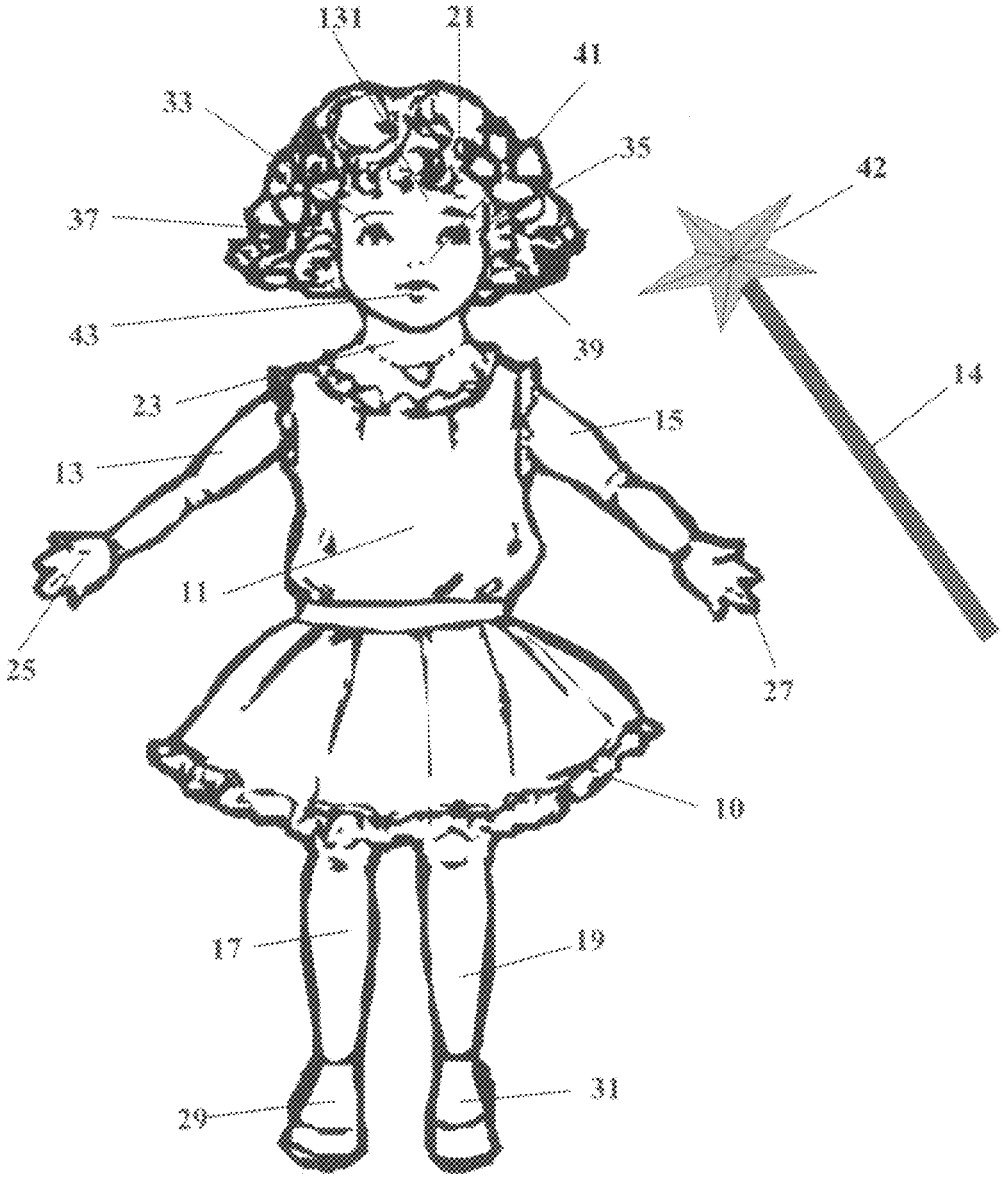
FIG. 1 shows a perspective view of an interactive talking doll and the baton with a star compartment of the present invention.

Referring now to the drawings where the illustrations are for the purpose of describing the preferred and alternate embodiments of the invention and are not intended to limit the invention hereto, FIG. 1 is perspective view of a doll device in the form of a human child 10 together with the "magic" baton 14. The doll device 10 is comprised of a belly 11 to which arms 13, 15 and legs 17, 19 and a head 21 are connected. The head 21 consists of an injection-molded skull preferably made from a commercially available, non-toxic rigid polymer and a flexible outer surface or "skin." The skull is connected to the body by way of a neck 23. At the end of the arms 13, 15 are hands 25, 27, and at the ends of the legs 17, 19 are feet 29, 31. On the head area 21, the doll has eyes 33, 35, ears 37, 39, a nose 41 and a mouth 43. Internal to this doll device are the speech mechanism, the magnetic sensors which act as the player interface to the doll, a micro-processor that controls the operation of the doll, the electronic circuitry that generates the speech data signals and feeds them to the speaker, the speaker, the solenoids which activate the eyes and jaw mechanisms, the multi-color LED's, the power control circuitry, and the infra-red module.

Figure 3:
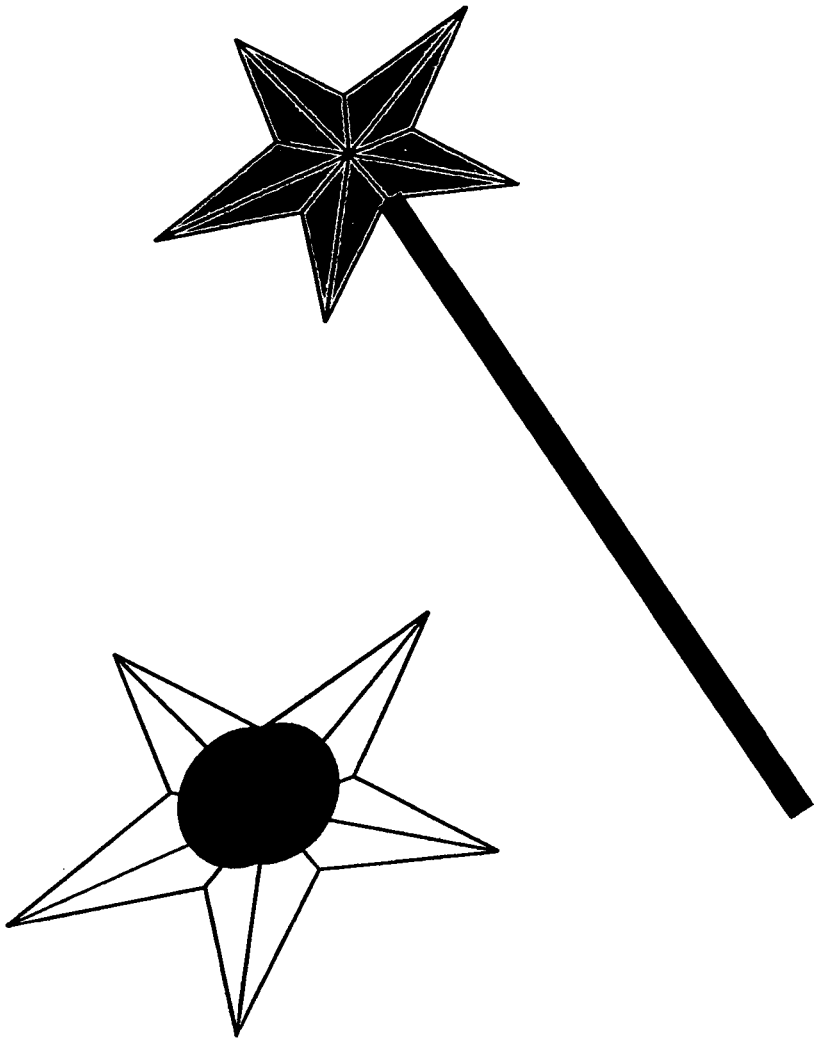
FIG. 3 shows the baton and the placement of the permanent magnet in the star compartment.

The "magic" baton, which is shown in FIG. 3, is comprised of a cylindrical rod 38 about one foot to a foot and a half in length and made of a plastic or wooden material. At one end of this rod is the "magic" star compartment 42, which holds a permanent magnet 44.

Figure 46:
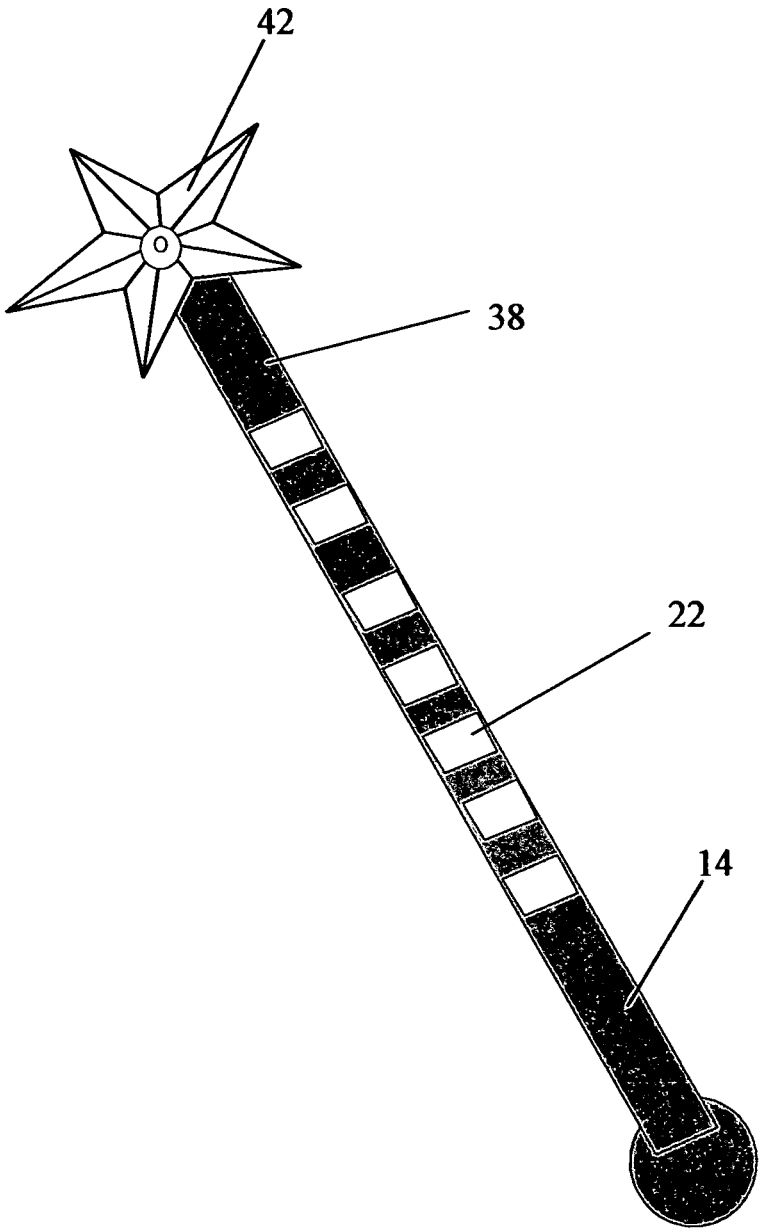
FIG. 46 is an alternate design for the baton showing a plurality of pressure switches located on the surface of the rod.

An alternate design for the "magic" baton is shown in FIG. 46, and includes a plurality of pressure switches 22 located on the cylindrical rod 38. The switches are colored for ease of identification by the player. The rod also includes a compartment to house two "AA" or "AAA" batteries. The star compartment is made out of a transparent but diffused material to allow light to emit from the star housing. The compartment includes a multi-color LED, which is activated by any of the switches located on the rod. Upon the activation of any switch, the compartment will emit a colored light that corresponds to the color of the activated switch. Such a color scheme is used to help the player remember his or her response to a specific request by the doll. The baton also includes electronic devices connected to an infrared transmitter located in the star compartment. The function of the electronic circuitry is to identify which switch was activated by the player and to transmit such information to the doll device using an infra-red communication module. The "magic" star compartment 42 holds the infrared transmitter in addition to the permanent magnet 44. The infrared transmitter transmits information to the doll device regarding the location of the pressure switch activated by the player. Upon the activation of a magnetic sensor and receiving data from the baton, the microprocessor will associate the location of the pressure switch with interaction generated by the doll device. It should be noted that the configuration of pressure switches and infrared modules can be used without the permanent magnet and magnetic sensors to provide a means to control the doll device. The use of pressure switches together with magnetic sensors will provide for an enhancement of play.

Figure 2:
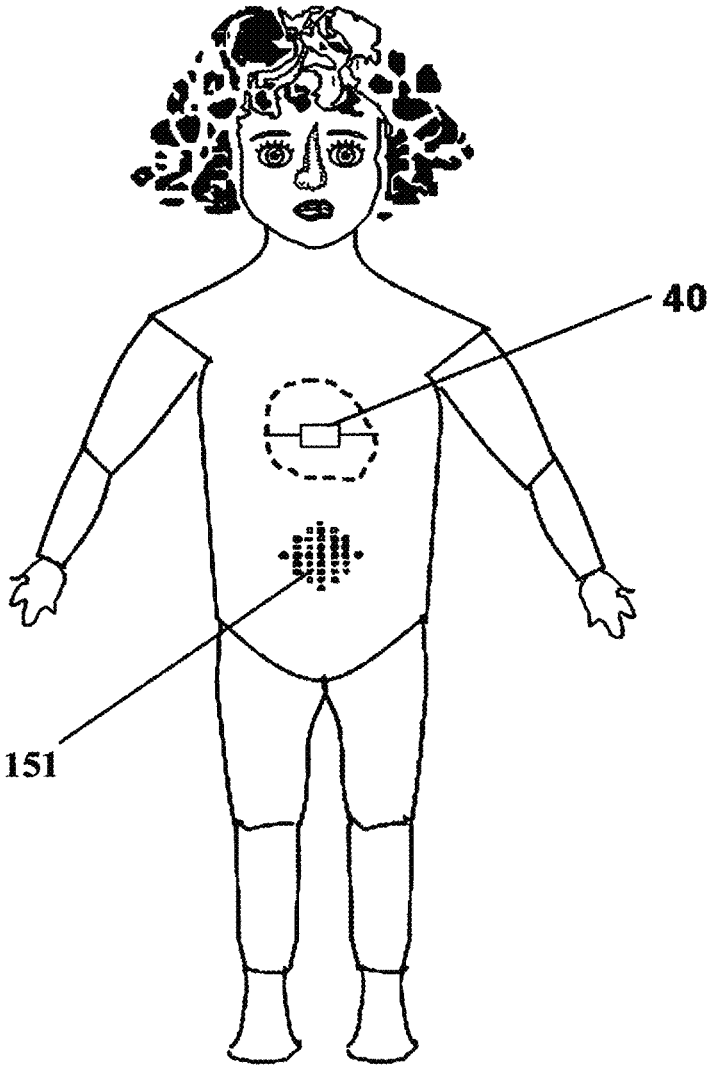
FIG. 2 shows a fragmentary front elevation view of the doll of FIG. 1 with part of the outer skin or covering removed.

Within various parts of the doll are magnetic sensors that are set beneath the doll's skin. FIG. 2 shows a cutaway of FIG. 1 revealing the placement of the magnetic sensors 40 and other internal parts within the doll housing. Some of these sensors are placed at various locations in the head frame, as shown in FIG. 2, including four positions below the left and right ears 37 & 39, beneath the mouth 43, on the forehead 31 and on the back of the head 21. Similarly, additional magnetic sensors are placed within the material that form the hands 25 & 27, arms 13 & 15, legs 17 & 19 and feet 29 & 31. Also, two magnetic sensors are placed within the stuffing material that comprises the belly region 11, the back area and the neck 23. A total of sixteen magnetic sensors may be provided. The magnetic sensors are located in a way that prevents the activation of more than one sensor when a player brings the "magic" baton 14 to a close proximity of any part of the doll 10.

Magnetic sensors may be constructed using electromechanical, electronic or other designs. In an electromechanical construction, each of the magnetic sensors is comprised of a light ferrite armature, which is pivoted at one end and connected to a momentary single pole switch that is normally held in the open position by means of spring action. A magnetic sensor is mounted below the outer surface of the doll such that the armature is facing said surface and can only move towards the surface when pulled by a magnetic field of sufficient strength to overcome the spring force that is holding the armature away from the outer surface of the doll. The operation of the magnetic sensor is such that when a player moves the "magic" baton 14 to a close proximity of a sensor, the magnetic field from the permanent magnet 44, which is housed in the star compartment 42 of the baton, will activate the armature by pulling it and rotating it around its pivot. This in turn will close the momentary switch causing a signal to be send to the micro-processor identifying the location on the doll where a "magic touch" has just taken place. When the player moves the baton 14 away from the doll 10, the magnetic field will weaken and, as a result, the momentary switch will open by spring action. To ensure proper operation of the magnetic sensors 40, contact bounce routines or filters are utilized within the microprocessor.

It should be clearly understood that the selection of magnetic sensors and/or pressure switches to provide the player with an interface to the doll is for the purpose of describing the preferred embodiment and is not intended to limit the invention hereto. Such an interface can be provided by other entry control means including the use of pressure switches located on the body of the doll device, micro-switches or any other type of electromechanical switches described in the art of electrical switches. Further, speech recognition means, photocells, laser detectors or proximity detectors could be used as the player's interface to the doll device. Further, the selection of sixteen sensors is for demonstration purposes only. Any number of sensors can be used to achieve the desired functionality of the preferred embodiment.

The sixteen magnetic sensors are connected to the microprocessor in a 4×4 matrix configuration. These interconnections should preferably be made similar to that used in key pad switches to simplify software development and interface circuitry.

Solenoids are located within the doll's face and are connected to the eyes and lips of the doll. Two solenoids are connected to the left and right eyes 33 & 35 and have the function of opening and closing each eye independent of the other. Two configurations may be used with respect to lip movement. In the first configuration, two solenoids are used to activate each of the pair of lips 43. In the second configuration, the upper lip is fixed so that only a single solenoid with a single attachment point is used to implement lip movement. In the second configuration, the solenoid is connected to the jaw part of the face, which holds the lower lip and has the function of oscillating the jaw to create lip movements when the doll is generating speech. The microprocessor performs the function of synchronizing jaw and lips movements with the generated speech. Each solenoid is comprised of a cylindrical electrical coil that activates an internal ferrite rod, which is held in the de-energized or "off" position by spring action. When the solenoid is energized, the magnetic field generated by the electrical coil pulls the rod towards the "on" position causing the rod to move along the axis of the coil. Since the operation of a solenoid is usually fast, a damper and/or a gear assembly may be used to slow down the movements of the jaw in order to create realistic lip movements when speech is being generated from the doll. It should be clearly understood that the selection of solenoids to implement eye and lip movements has been made with reference to the preferred embodiment of the invention. It is possible to make other embodiments that employ alternate means for activating eyes and lips. Such alternate means are well known to those skilled in the art.

Each of the solenoids 51 & 53 is connected through a wire to a memory decoder driver 55 which incorporates a digital to analog converter that transforms digital information, generated by the CPU 70 based on the logical steps of the control program, into an analog signal of a strength that is proportional to the digital information received from the micro processor.

Figure 4:
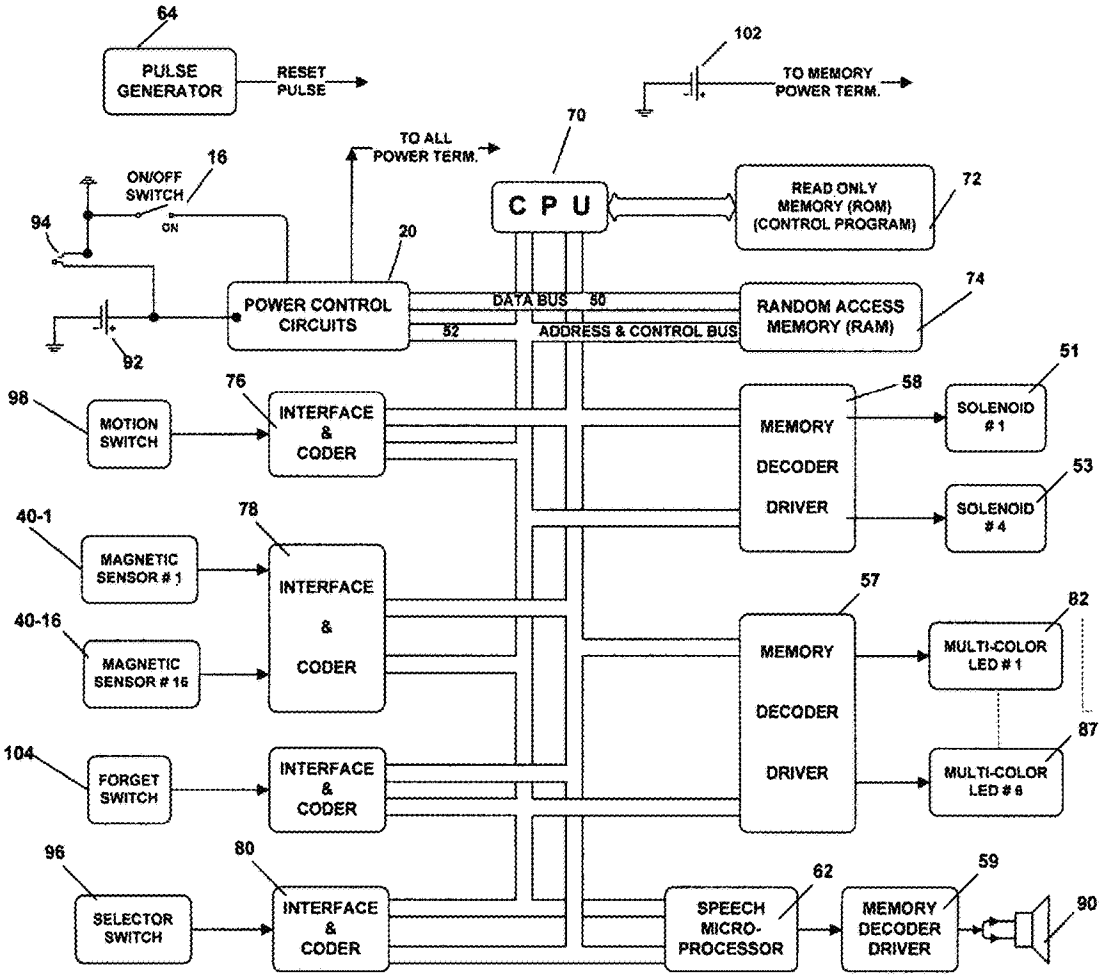
FIG. 4 is a block diagram of the control circuits utilized by the preferred embodiment in accordance with the current invention.
Figure 5:
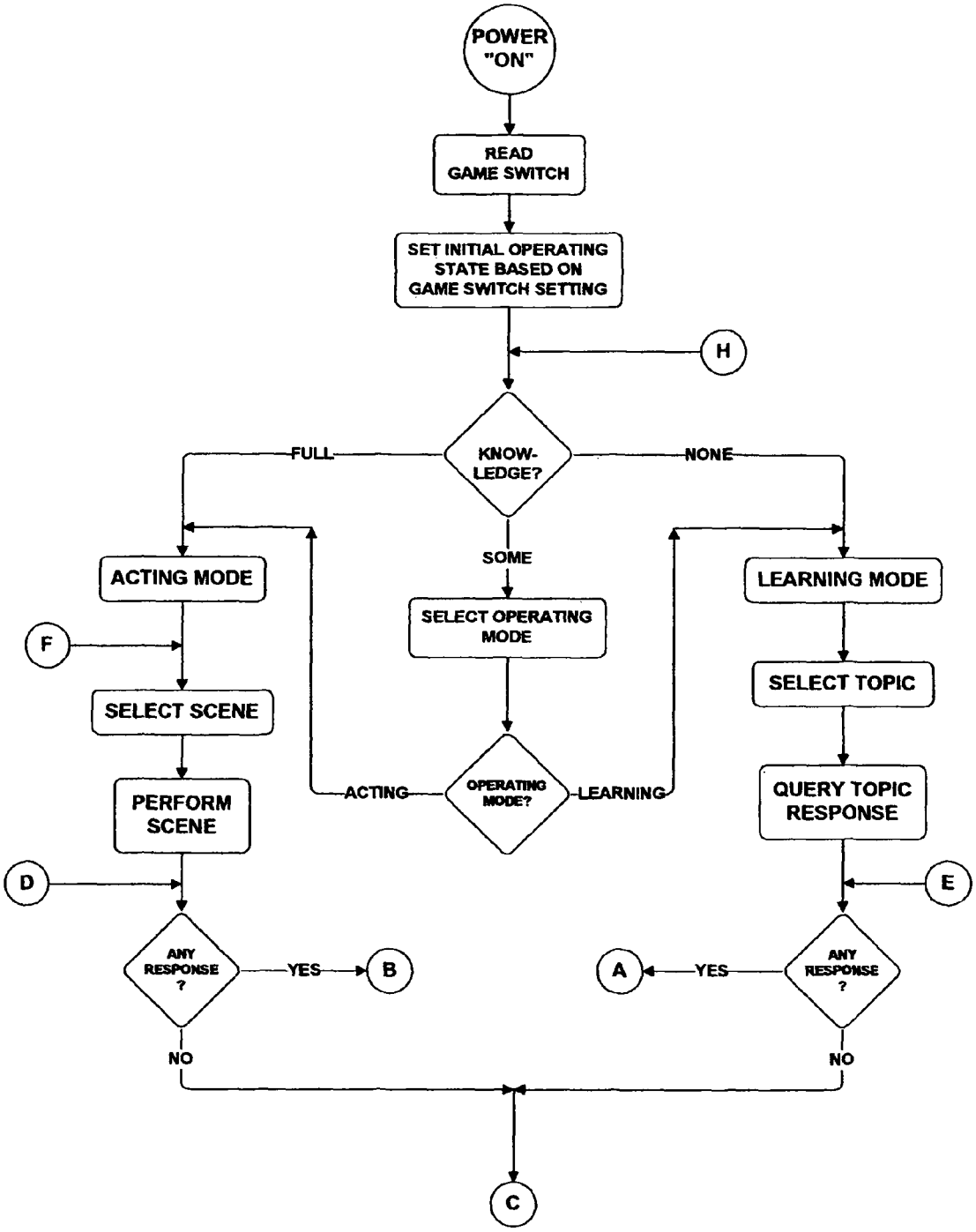
FIGS. 5-9 is a universal logical flow diagram illustrating the logical steps utilized by the preferred and alternate embodiments according to the invention.
Figure 6:
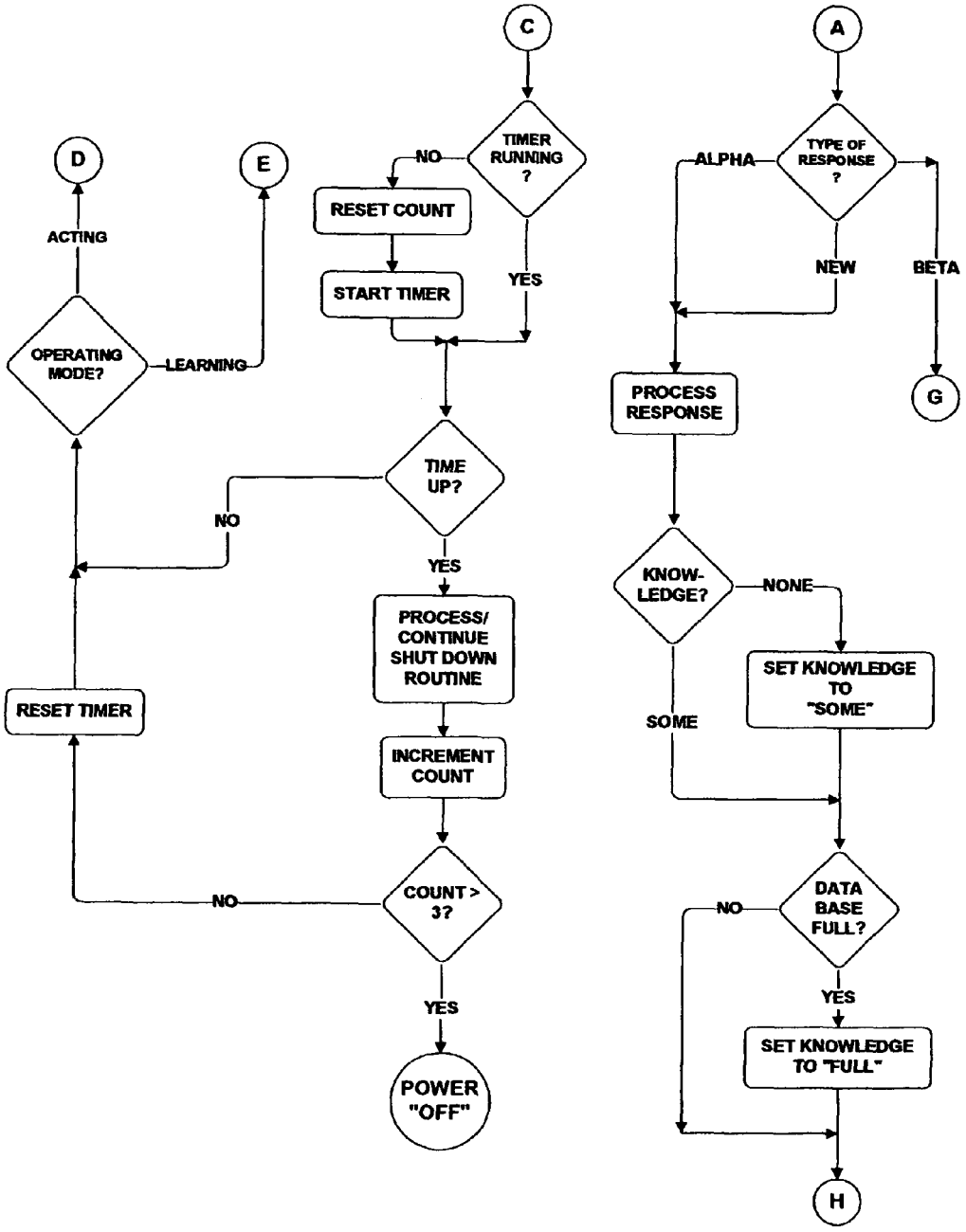
Figure 7:
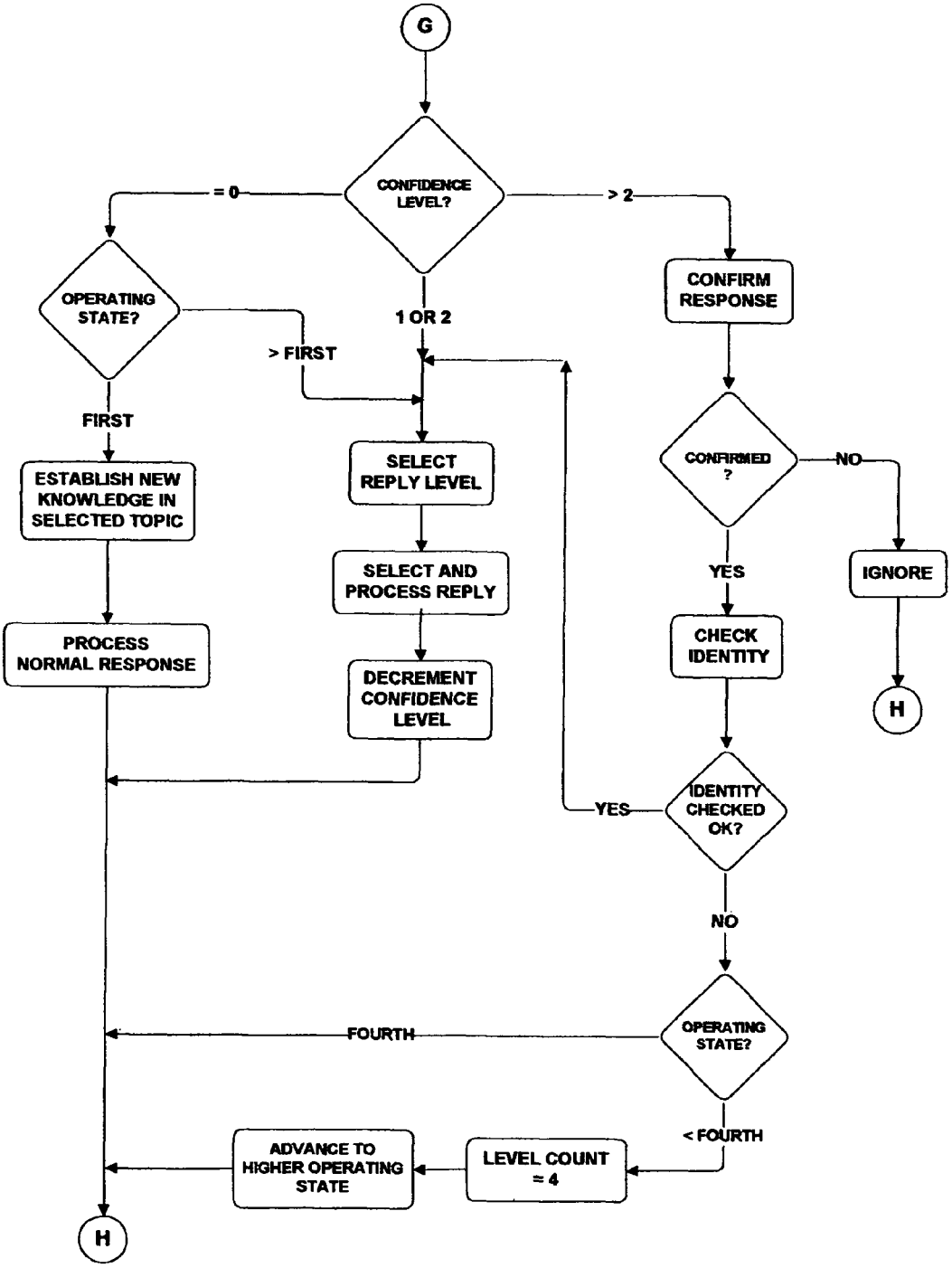
Figure 8:
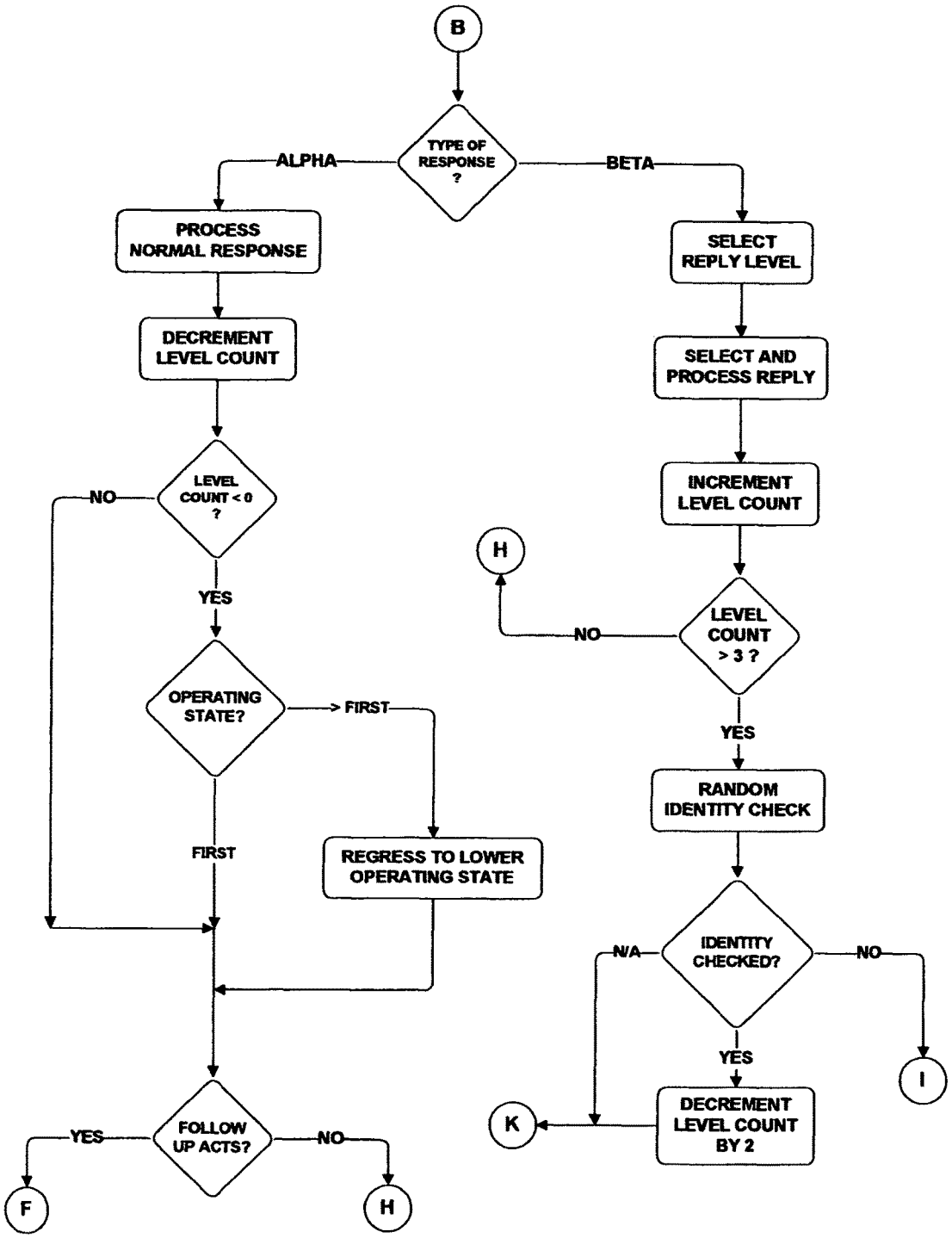
Figure 9:
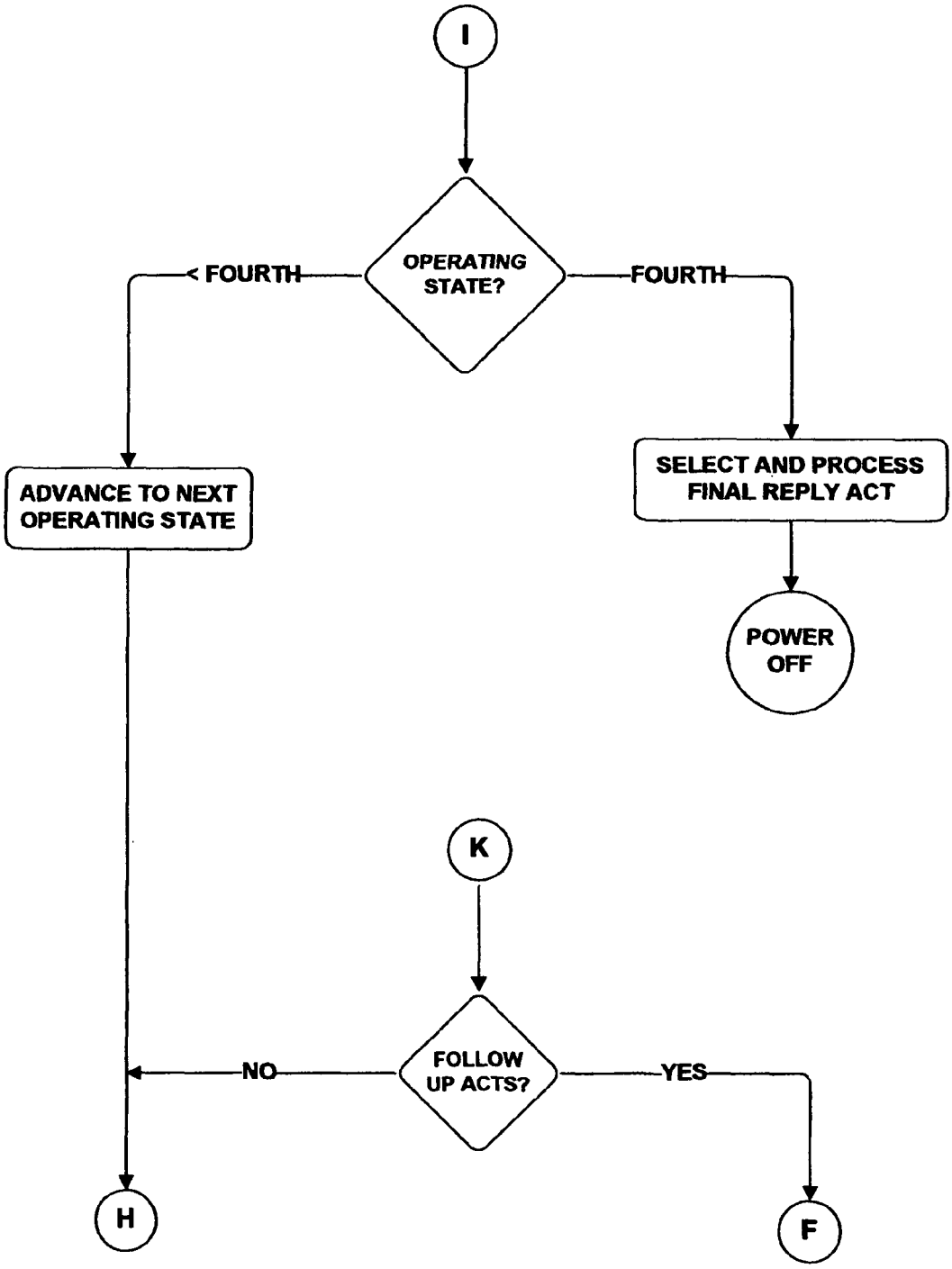
Figure 10:
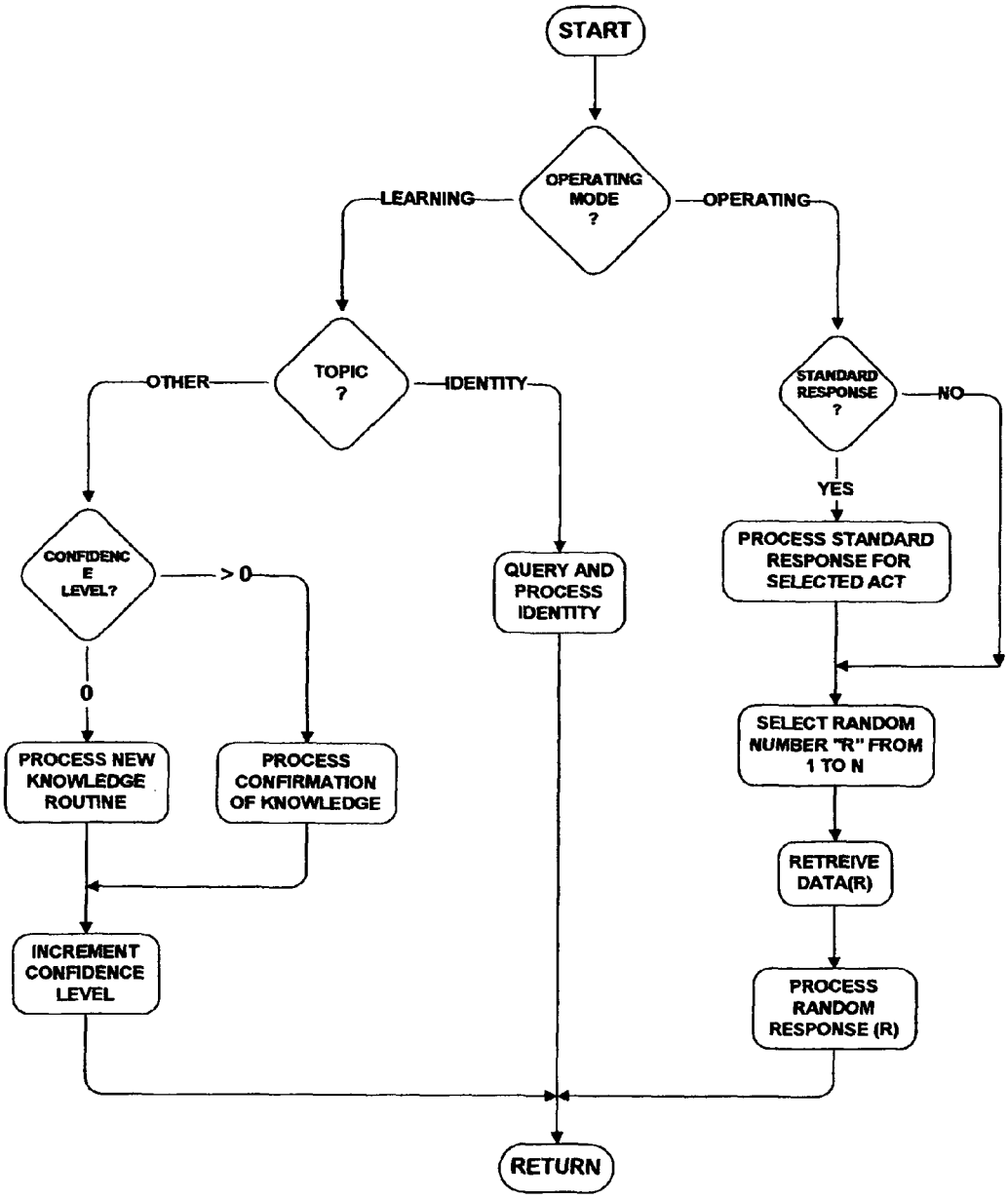
FIG. 10 is a proposed logical flow diagram of a customized routine for the doll device that processes responses by the player.
Figure 11:
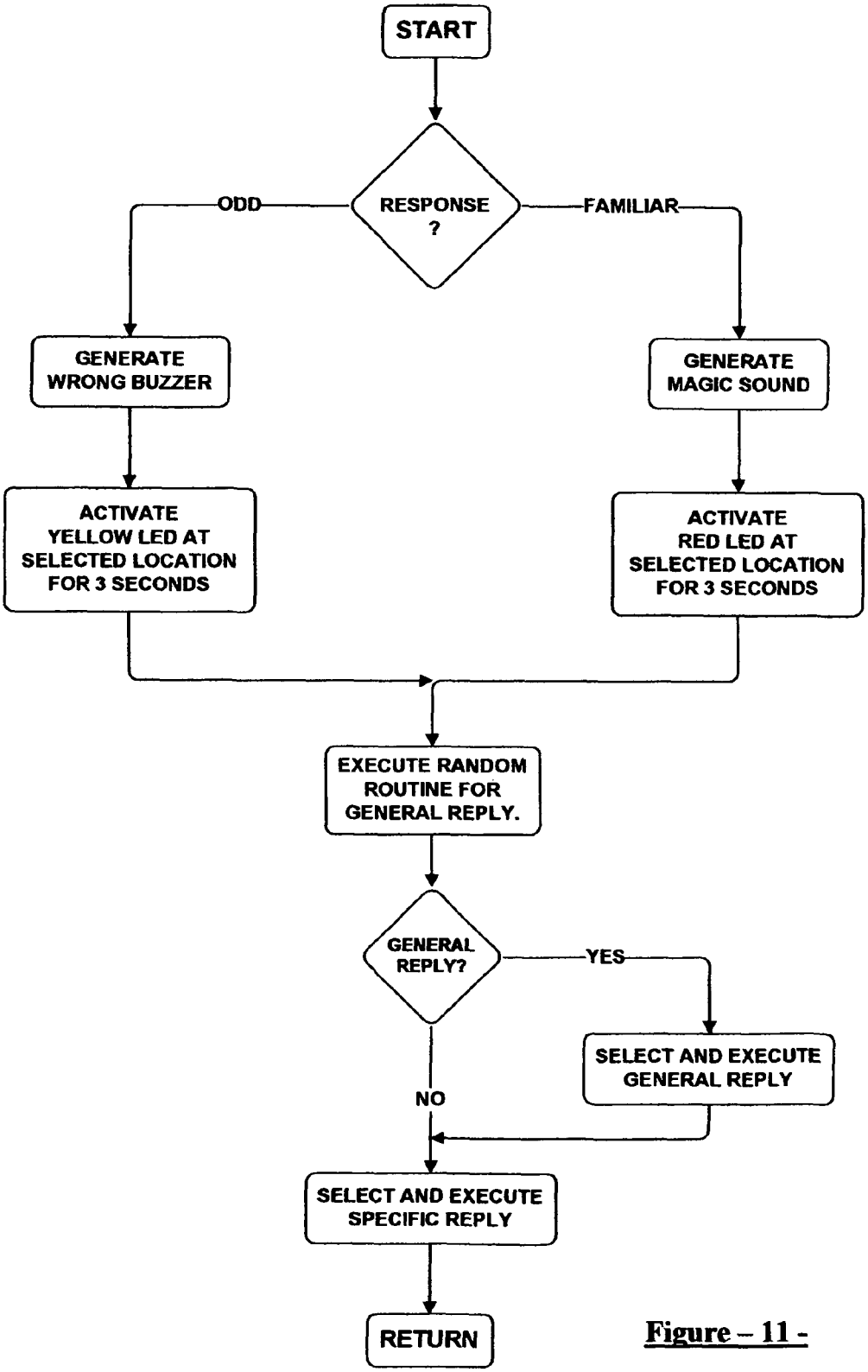
FIG. 11 is an example of a proposed logical flow diagram of a routine for the doll device of the preferred embodiment, which process responses by the player.

A block diagram of the control circuitry for this doll device is illustrated in FIG. 4. This control circuitry includes a central processing unit 70 having a control program memory associated therewith, a read only memory (ROM) 72, a random access memory (RAM) 74, a plurality of interface and coding devices 76, 78 & 80, a plurality of memory decoder drivers 55, 57 & 59 and a micro-controller 62 for speech generation. The interface and coding devices 76, 78 & 80 are used as an input interface between the magnetic sensors 40 and other control components with the central processing unit 70. As such, the 4×4 matrix interface 78 is associated with the sixteen (16) magnetic sensors 40, interface and coding device 80 is associated with the game selector switch 96 and interface and coding device 76 is associated with the Motion Switch 98. In contrast, memory decoder devices 57 & 58 are used as the output interface between the central processing unit 70 and the multi-color LED's 82-87 and the solenoids 51 & 53. A common address and control bus 52, and a separate common data bus 50 are used to interconnect the central processing unit 70 with the interface and coding devices, the memory decoder drivers, the read only memory (ROM) 72, the random access memory (RAM) 74 and the speech micro-controller 62. If an infrared module is used, then such a module will be interfaced and interconnected with both data bus 50 and address and control bus 52. It should be noted that a 4-bit or an 8-bit micro-controller could be used in lieu of the microprocessor shown in FIG. 4. In such case, an Arithmetic Logic Unit ("ALU") will perform the functions of the CPU 70. The micro-controller will have an internal read only memory (ROM), an internal random access memory (RAM), registers and I/O ports including serial ports. The I/O ports will be used to interface with the various switches, LED's, solenoids, speaker and infrared modules.

The central processing unit 70 controls the flow of all information throughout the entire doll device under the direction of the control program. The control program resides in the read only memory (ROM) 72.

The speech micro-controller 62 is a processor-based device, which includes its own speech ROM, program ROM, data RAM and clock circuitry. This type of speech micro-controller is commercially available in a single integrated chip with serial and parallel digital interfaces to control the operation of the micro-controller. The integrated chip can be custom-manufactured with prerecorded speech data that have been digitized, processed and synthesized. The speech data includes a plurality of prerecorded requests, answers and replies grouped and classified to match the operating states of the doll device. Samples of these prerecorded speech data are shown in FIGS. 17-25. Each of the prerecorded messages is addressable and can be selected by the CPU 70 for playback by simply activating the speech micro-controller 62 and transmitting to it the code associated with the selected message. The micro-controller is connected to a small speaker 90 approximately 2 inches in diameter, which is positioned in the middle portion of the doll's belly 11, and perforations 151 are provided to permit sounds from the loudspeaker to issue from the doll's housing.

It should be clearly understood that the selection of a separate micro-controller 62 to provide prerecorded digital messages is for the purpose of describing the preferred embodiment and is not intended to limit the invention hereto. This micro-controller 62 can be combined with the main CPU 70 to provide an integrated singular controller for the doll device which implements all functions provided by the device including speech generation. In such a configuration, both the digitized prerecorded speech data and control program will reside in the same ROM 72.

A plurality of dry cell batteries 92 for powering the doll device are placed in a removable mounted battery pack positioned in a control box within the doll's enclave. A pivoted door is provided for the player to access the batteries. The batteries 92 provide the main electrical energy necessary for the operation of the doll device. An external jack 94 is being provided to connect the doll to an external power source for charging the main batteries. A secondary battery 102 is placed in a separate compartment and provides a backup power for the memory subsystem, which holds the knowledge data gained by the device. This second battery is necessary to ensure that said data is not lost when the main battery 92 is totally drained or during the time when said primary battery is being disconnected or replaced. The connection of either of the main 92 or secondary 102 battery is sufficient to provide electrical energy to the memory devices.

An on/off toggle switch 16 is provided to control the overall operation of the doll device. This switch controls the connection of the main battery 92 to the power control circuits 20 through the use of an electronic switching device integrated within the power control circuits. Said power control circuits 20 in turn controls the power connection to the various components of the doll device. The power control circuits are, also, connected to the CPU 70 via the data bus 50 and the address & control bus 52. This would enable the control program to trigger the switching device and turn the power "on" or "off" for the initiation or termination of play sessions. The power control circuits provide power interconnections to the central processing unit 70, the speech micro-controller 62 and other components of the doll device.

A motion sensor switch 98 is being provided as a means to initiate a play session. Upon the movement of the doll device, the motion sensing mechanism associated with the switch will provide a signal to the CPU 70 that the doll device has been moved. This will result in a new playing session. A time delay of approximately three (3) minutes is being provided to prohibit the start of a new play session following the termination of play. This will prevent the doll from initiating a new play session immediately following the conclusion of a play session either by the player or by the doll device. Other sensors such as light sensor, sound sensor or the like may be incorporated in the doll device to provide additional functionality and/or features. For example, a light sensor can be used by the doll device to distinguish between light and darkness. Such features can be incorporated in the interactions generated by the doll device.

A "forget" switch 104 is provided to enable the player to erase all information knowledge stored in the doll device. Upon the activation of this switch, and subject to a successful identity check, the doll will prompt the player to confirm if he or she would like to erase the knowledge data. The player may then confirm the forget function request by reactivating the switch within a predetermined period of time.

A game selector switch 96 permits the player to choose between a plurality of games that are provided by the doll device. Three basic games are provided. However, only under Game 1 the doll is capable of memorizing the responses by the player. Accordingly, Game 1 represents the main intended operation for this doll device. Under the setting for Game 1, the device performs learning and acting tasks through interactions with the player using actual knowledge gained during past interactions. Game 2 is limited to the acting mode and can only be selected after the device has gained sufficient knowledge related to previous interactions with the player. Under the setting for game 2, the control program selects an initial operating state for the play session. This initial operating state is randomly selected from operating states within level 3 or level 4. The player is then challenged to bring the doll to a "happy" operating state through a plurality of interactions with the doll device. Game 3 is similar to game 2 except that an alternate knowledge database is used to interact with the player. This alternate database is selected by the control program from a plurality of data bases stored in memory and is not based on historical interactions with the player. Similar to Game 2, the player is challenged to bring the doll to a "happy" operating state from an initial operating state selected at random from operating states within levels 3 or 4. Since the player is not familiar with the selected knowledge database, he or she must guess as to which response or "magic touch" is associated with a particular interaction. Unlike Game 2, the selection of Game 3 is not limited by the amount of knowledge gained by the device. Both Games 2 & 3 would terminate if the player is successful in bringing the doll to a "happy" state or if the player is unable to make the doll attain such a state within a predetermined period of time or within a predetermined number of interactions.

It should be noted, and as will be understood by those skilled in the art, it is not necessary to provide an individual separate switch for each desired control function. The aforestated control switches can be combined to provide the same control functions. For example, the On/Off switch and the game selector switch can be combined into one control mechanism.

With respect to the operation of the doll device, the device is controlled by the universal logic steps disclosed and illustrated in flow diagram from FIGS. 5 through 9 which are interconnect with each other at places shown in the various figures. This flow diagram and associated logic steps is generic in that it can be used to control any other toy device with similar operating concept and/or with functions that are similar to those of the doll device herein. One example of such other toy devices is the car device disclosed in the alternate embodiment.

The universal flow diagram includes two main operating modes labeled "learning" and "acting" and, also, comprises a plurality of operating levels that can be selected from the operating modes based on the disclosed logical steps, historical responses, the knowledge information data base and the classification of the last response received from the player. Responses are generically classified as "Alpha" or "Beta." This classification using a two response groupings is for the purpose of describing the preferred embodiment. Responses can be classified using three, four or more response groupings. Four generic operating states labeled "level 1", " level 2", " level 3" and "level 4" are being provided as part of the universal flow diagram to form the basis for the operation of the play device. The selection of an initial operating state is dependent in part on which game has been selected by the player. Level 1 is selected during the early phases of the learning process when the response or knowledge data base is in the early stages of being developed. This operating level is, also, selected when responses received from the player fall within the "Alpha" classification. In the case of the doll device, "level 1" is selected when responses fall within the "familiar" classification. Level 2 is selected when responses begin to deviate from the "Alpha" or "familiar" stored responses. As the frequency of "Beta" responses increases ("odd" responses for the doll device), level 3 will be selected and then level 4 will be invoked when the majority of responses becomes "Beta" or "odd." An operating state within levels 3 or 4 is also selected as an initial operating state for Games 3 or 4 in the case of the doll device. Under the setting for Game 1 for the doll device, a final act in a play session is performed by the device during the implementation of the level 4 operating state to terminate the play session. Examples of such final act are shown in FIG. 25. For the purpose of describing the preferred embodiment, this final act usually results in terminating the play session and turning "off" the play device as the doll goes to "sleep." It should be noted that, during a play session, a toy device may switch from a higher generic state to a lower generic state if the responses received from the player regress to the "Alpha" responses. Following the termination of a play session by the doll device, the player may reactivate the on/off switch to initiate another play session. Alternatively, if the doll has been in the "sleep" state for more than three (3) minutes, and upon the lifting and/or movement of the doll device by the player, the motion sensor switch will trigger a new play session.

To implement the universal flow diagram, each generic operating state is realized using a plurality of specific operating states. For example, in the preferred embodiment, level 1 includes the "happy", "joyful" and "playful" operating states; level 2 includes the "doubt" and "confused" operating states; level 3 includes the "sad" and "angry" operating states and level 4 includes the "challenge" and "defiance" operating states. Random elements are used, as a factor, to select between specific operating states within the same generic state. Even though specific reference will not be made to this flow diagram in the following description of its application to the operation of the doll device, periodic reference to the diagram may prove to be helpful to the reader hereof.

Upon the start of a play session and based on the specific play device, an initial operating state will be selected by the device. The selection of the initial operating state may include a random process or may be dependent on a selection, by the player, between a plurality of games provided by the device. Following this selection, the microprocessor will check the level of knowledge gained by the device through previous interactions with the player. If no knowledge information is stored in memory, then the initial operating mode would be set to the "learning" mode. Conversely, if the device had gained all the knowledge it can obtain, the "acting" operating mode will be selected. Alternatively, if only partial or some knowledge had been gained by the device, a random process will select the initial operating mode. This random process is skewed based on the level of knowledge gained by the device. As per the aforestated disclosure, some games in certain play devices do not require the invocation of the "learning" mode. For such games, the "acting" mode will be selected for each and every interaction within a play session.

Upon the determination of the initial operating mode, and assuming that said initial mode is the "learning" mode, the micro-processor will select a topic or an act from a plurality of predetermined subjects or acts to be queried or executed by the device. The device will then await a response from the player. If no response is received, then a shut down procedure will be executed to turn the device "off." This shut down procedure includes three cycles and within each cycle the device will perform an act, selected at random from a predetermined plurality of acts, alerting the player that the play session is about to terminate.

Upon receiving a response from the player, the device will determine its type and will classify it as one of the three categories: "Alpha", "Beta" or "New." A response is classified as "New" when it is received for the first time from the player in connection with a topic or an act. If the response is "Alpha" or "New", then the device will process the response in accordance with predetermined specific replies. For the doll device these specific replies are shown in FIG. 17. The control microprocessor will, also, update the status of the database to reflect the knowledge gained during this interaction. Upon the completion of this interaction cycle, the microprocessor will return to the point in the generic flow diagram for the selection of new operating mode and the start of another interaction cycle.

Conversely, if the response is "Beta," then the microprocessor will first check the confidence level of the stored knowledge associated with the topic or act. If said confidence level is "0," then the microprocessor will perform a sequence of tasks based on the operating level in effect. Under the First operating level, the microprocessor will establish new knowledge in connection with the topic or act and will then process the response as if it was "Alpha" or "New." If the operating level is higher than First, then a reply level will be selected based on the operating and confidence levels. FIGS. 13, 14, 15 & 16 indicate proposed reply levels as a function of the operating state, confidence level, operating mode and type of response. The reply level will then be used to select and process a reply. For the doll device, examples of specific replies are shown in FIGS. 17, 18, 19 & 20. Examples of general replies are shown in FIGS. 23, 24 & 25. Following the processing of the selected reply, the microprocessor will decrement the confidence level to reflect the "Beta" answer. The same sequence of tasks will, also, be performed if the confidence level is "1" or "2". After the completion of said sequence of tasks, the microprocessor will return to the point in the generic flow diagram for the selection of a new operating mode and the start of another interaction.

Figure 12:
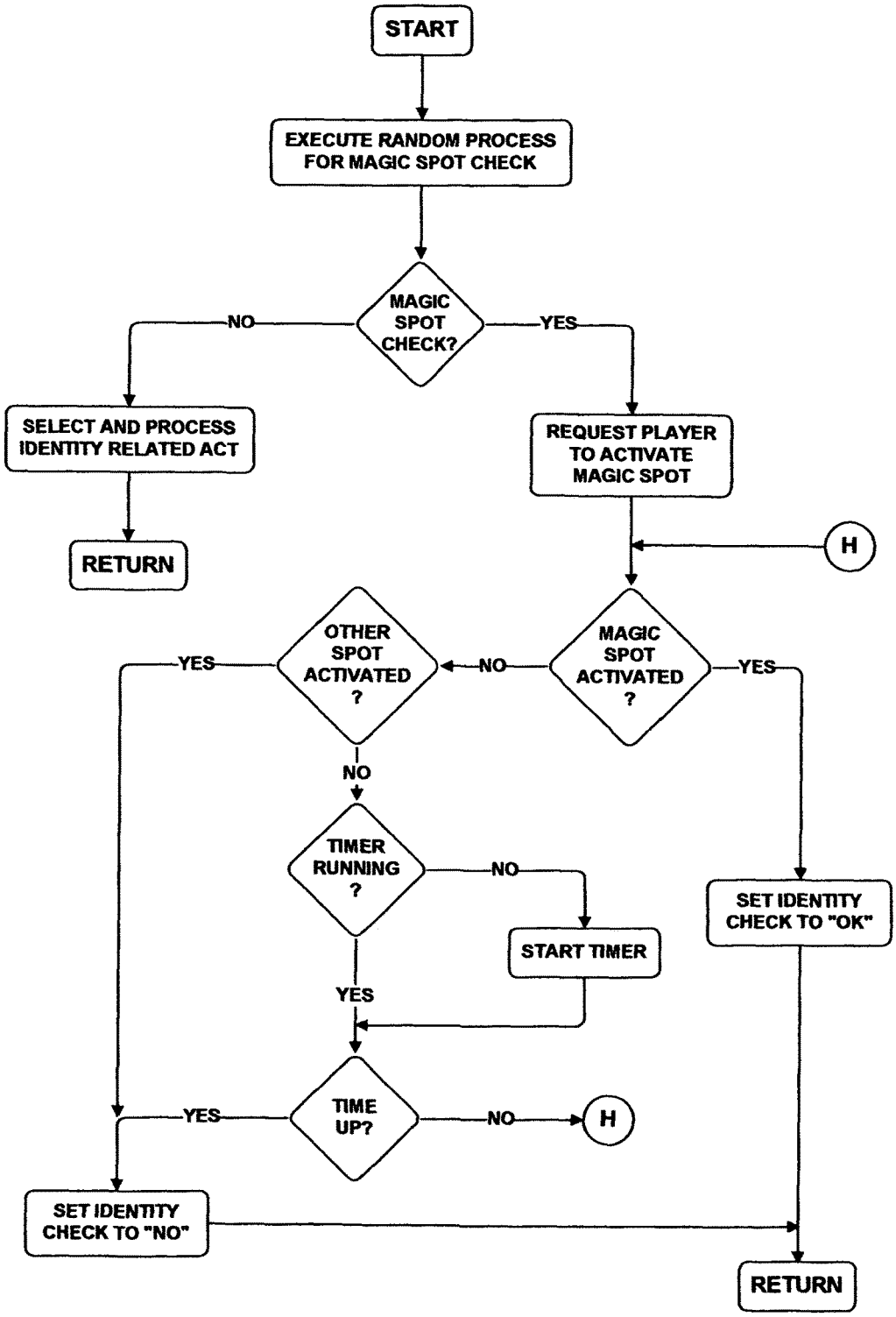
FIG. 12 is a proposed logical flow diagram of a routine for the doll device that checks the identity of the player.

If the confidence level is greater than "2", then the device will repeat the act or topic to confirm the player's response. The response will be ignored if it is not confirmed by the player. On the other hand, if the response is confirmed, then the microprocessor may execute the identity check routine shown in FIG. 12. This routine will select and process a positive or a negative identity check reply based on the result of the identity check. If the identity of the player is confirmed, then the same sequence of tasks referred to in the last paragraph will be executed followed by a selection of a new interaction. Conversely, if the identity of the player is not confirmed, then a decision will be made to either advance to a higher operating level if the current operating level is less than Fourth or to select and process a final reply act if the device is operating at the Fourth level. This decision is, also, based on the specific Game in effect. For the doll device, if Game 2 or Game 3 has been selected by the player, then the decision to process a final reply act will not be made until the expiration of a predetermined amount of time or until after the completion of a predetermined number of interactions as part of the play session. If the decision is made to advance to a higher level, then the microprocessor will execute a "Change Operating State" routine and a new interaction will be initiated by the device.

If the new interaction is based on the "acting" mode, then the microprocessor will select and execute a scene from a plurality of "authorized" episodes. A scene or an episode is "authorized" for selection and enactment under the "acting" mode only if it was previously selected during a "learning" mode and only if there is associated knowledge stored in the database. The selection between "authorized" episodes is based on a random process which ensures that the same episode or act will not be selected more than once within a predetermined number "N" of consecutive interactions provided that there are at least "N" or more authorized episodes, where N is an integer greater than 2. During an "acting" mode, the microprocessor will enact a topic that was previously learned by the device. Upon the completion of such enactment, the microprocessor will await a response by the player. Similar to the "learning" mode, If no response is received, then a shut down procedure will be executed to turn the device "off".

Upon receiving a response from the player, the device will determine its type and classify it as one of the two categories: "Alpha" or "Beta." If the response is classified as "Alpha," then a general and/or specific reply will be selected and enacted by the device. Upon the completion of said reply, the microprocessor will decrement the level count as part of gradual regression towards "level 1" operation. Each operating level has a maximum level count of 3. If the level count exceeds 3, then the operating state will advance to the next higher level. Conversely, if the level count is less than 0, then the operating state will regress to the next lower operating level. If a regression to a lower level is determined, then the microprocessor will execute a "Change Operating State" routine. The microprocessor will then determine if there are any follow up acts for the selected episode. If "Yes," the interaction will continue using said follow up acts. Conversely, if there is no follow up acts for the selected episode, then a new interaction will be selected.

On the other hand, if the response in an "acting" mode is classified as "Beta," then the microprocessor will determine the appropriate reply level based on the operating state in effect. A general and/or specific reply will then be selected and enacted by the device. Following the execution of the reply, the level count will be incremented by one, and random identity check may take place if the level count is greater than 3. If the level count is less than or equal to 3, then a new interaction will be selected. A random identity check is an identity check that may or may not be invoked based on a random process. If an identity check is invoked, then the microprocessor will execute the identity check routine of FIG. 12. Following a positive identity check, the level count will be reduced by two leading to a possible regression to a lower operating level if the level count drops below zero. A determination will then be made if follow up acts or a new interaction will be selected. Conversely, if the identity check is negative or if the random process does not lead to an identity check, a determination will be made to either advance to a higher operating level or select and process a final reply act prior to terminating the play session.

It should be clearly understood that the disclosed universal flow diagram is for the purpose of describing the preferred and alternate embodiments and is not intended to limit the invention hereto. As will be understood by those skilled in the art, modifications, additions and/or deletions of logic steps, changing the sequence of program flow, adding and/or deleting generic and/or specific operating states, changing the labels given to the generic or operating states, using three or more operating modes, or any other modification will all fall within the scope and intent of this invention. Similarly, the selection and classification of antonym responses as familiar/odd is for the purpose of describing the preferred embodiment and is not intended to limit the invention hereto. Different classifications of responses such as, good/bad, true/false, right/wrong, smart/stupid, clever/flimsy or the like may be used.

The doll-to-doll interaction feature requires the incorporation of an infra-red module and a program segment that executes when two dolls are placed at close proximity to each other. A plurality of doll-to-doll interactions is stored within the doll device and is based on the mood of each of the two dolls. The interaction is in the form of verbal conversation related to how each of the dolls "feel" based on its current mood. Accordingly, and if there are ten (10) programmed moods for each doll, then there is a potential for one hundred (100) possible different conversations that may take place between two dolls. The script for each conversation is stored in the ROM of the speech microprocessor 62, and selected based on information stored in RAM 74 related to the current moods of the two dolls. Upon receiving an infrared signal, each doll will transmit its current mood to the other doll. A predefined process will select which of the two dolls will initiate the conversation, and which doll will respond. Accordingly, the first part of the script for each conversation may vary depending on which doll is selected to initiate the interaction. Upon completion of a sentence that is part of a script, each doll will transmit a signal to the other doll to start its response or reply. Such a process will continue until the end of the interaction. Upon completion of a doll-to-doll interaction, no further interaction between the two dolls will take place until the interruption and re-establishment of infrared communications between the two dolls. An example of doll-to-doll interaction is shown in FIG. 47.

DETAILED DESCRIPTION OF AN ALTERNATE EMBODIMENT

Figure 26:
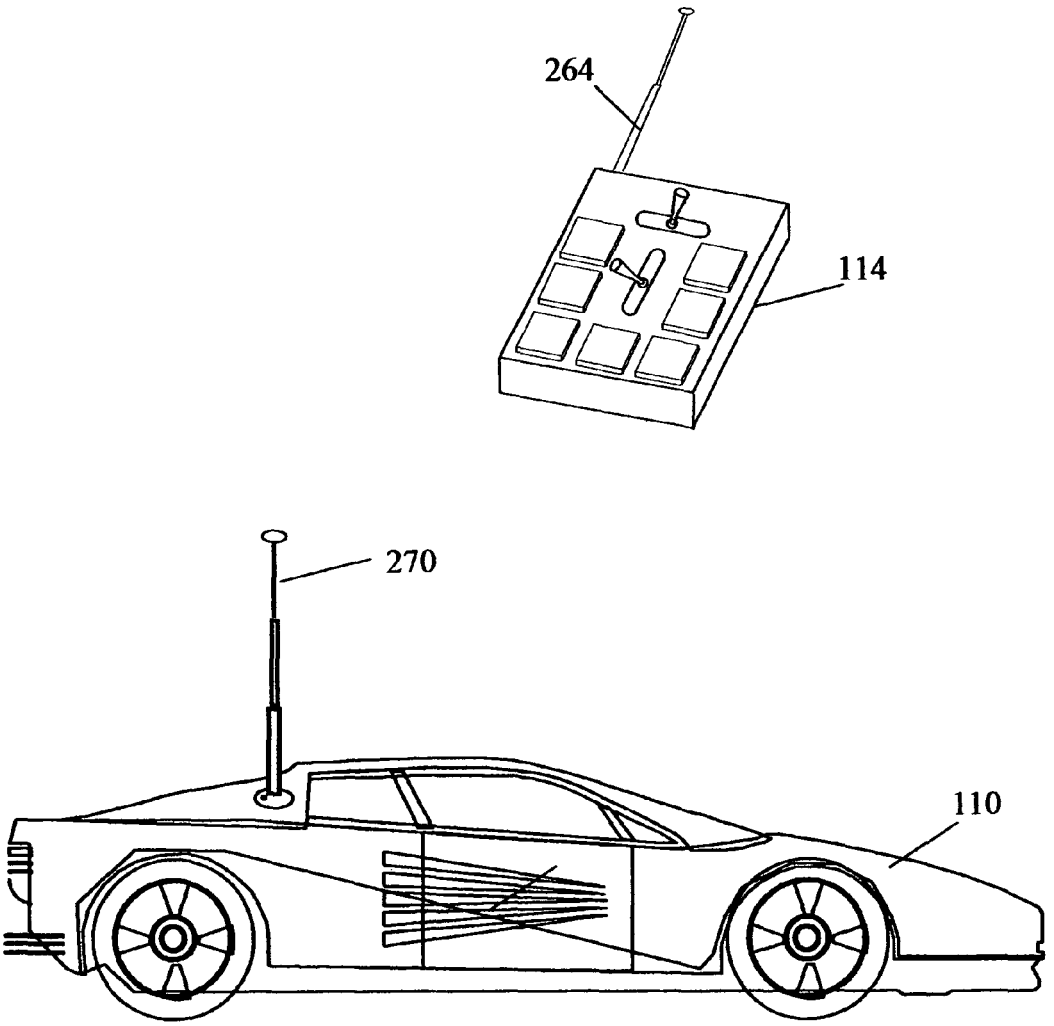
FIG. 26 is a perspective view of an interactive remote control car of the present invention.
Figure 27:
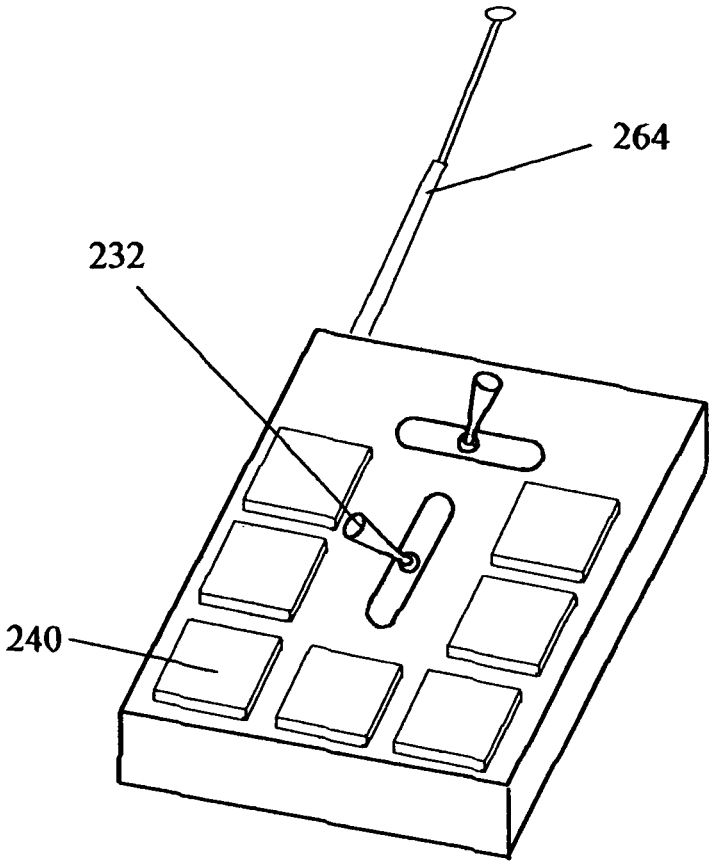
FIG. 27 is a perspective view of the remote control apparatus showing the additional controls in accordance with the alternate embodiment of the current invention.

Referring now to the drawings where the illustrations are for the purpose of describing an alternate embodiment of the invention and are not intended to limit the invention hereto, FIG. 26 is perspective view of a remote controlled toy car device 110 together with its remote control apparatus 114. The car device 110 is comprised of a car body having four wheels, a steering wheel and a plurality of multi-color lights. Internal to this car device are the radio receiver, the motor and gearbox, a microprocessor that controls the operation of the car, the electronic circuitry that generates the speech data signals and feeds them to the speaker, the speaker, and the power control circuitry.

Figure 28:
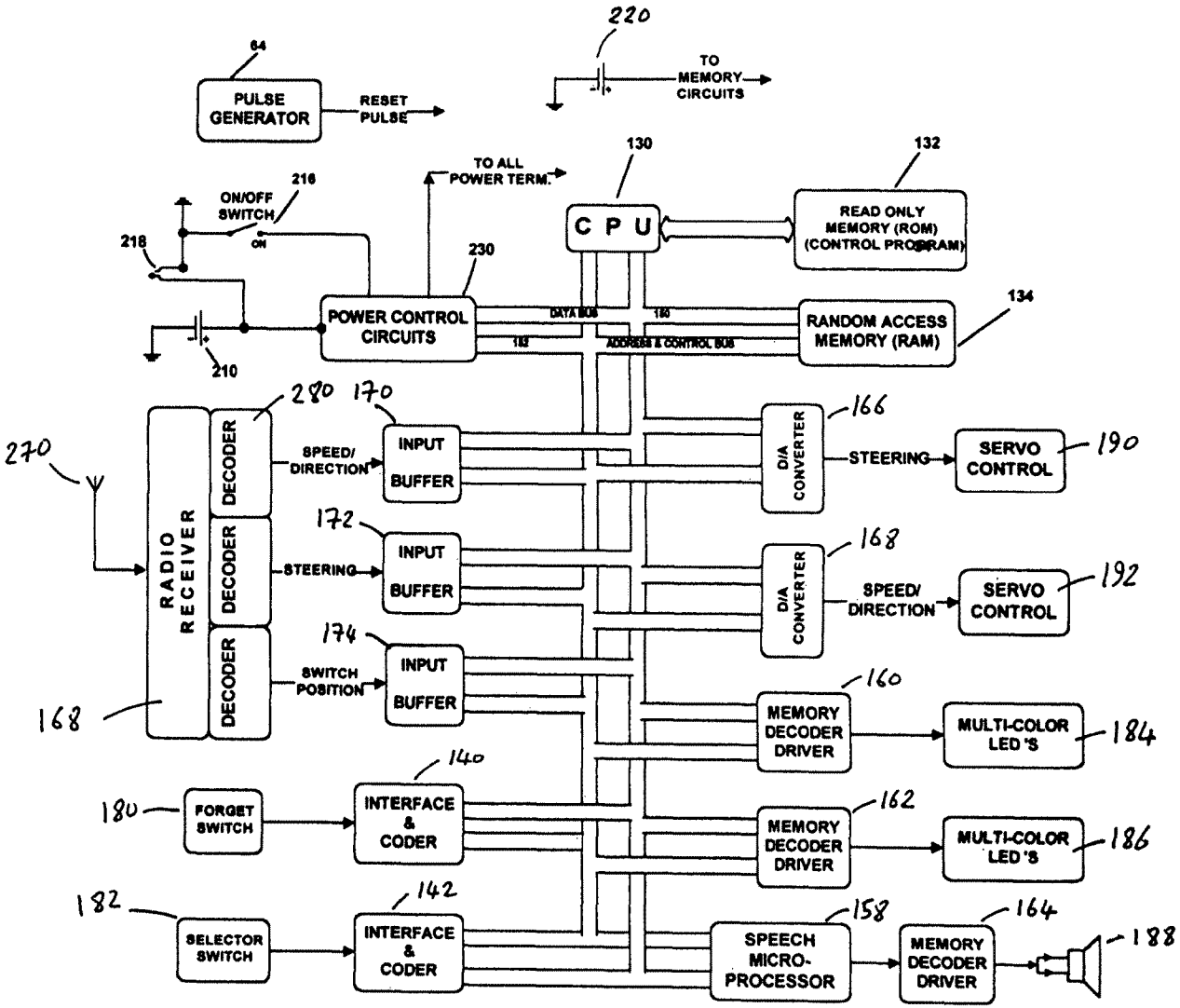
FIG. 28 is a block diagram of the control circuits utilized by the alternate embodiment according to the invention.

A block diagram of the control circuitry for this car device is illustrated in FIG. 28 This control circuitry includes a central processing unit 130 having a control program memory associated therewith, a read only memory (ROM) 132, a random access memory (RAM) 134, a plurality of interface and coding devices 140 & 142, a plurality of memory decoder drivers 160, 162 & 164, and a micro-controller for speech generation 158. The interface and buffer devices 170, 172 & 174 are used as serial interfaces between the radio receiver 168 and the central processing unit 130. Also interface and coding device 142 is associated with game selector switch 182 and interface and coding device 140 is associated with the forget switch 180. In contrast, memory decoder drivers 160, 162 & 164 are used as the output interface between the central processing unit 130 and the multi-color LED's 184 & 186. Digital to analog converters 166 & 168 are used to interface the CPU 130 with the steering servo control 190 and the speed/direction servo control 192. A common address and control bus 152, and a separate common data bus 150 are used to interconnect the central processing unit 130 with the interface and coding devices 140 & 142, the memory decoder drivers 160 & 162, the input buffers 170, 172 & 174, the D/A converters 166 & 168, the read only memory (ROM) 132, the random access memory (RAM) 134 and the speech micro-controller 158. An infra-red module with proper interfaces may be used in lieu of the indicated radio control modules.

It should be noted that a 4-bit or an 8-bit micro-controller can be used in lieu of the micro-processor shown in FIG. 28. In such case, an Arithmetic Logic Unit ALU will perform the functions of the CPU 130. The micro-controller will have internal read ROM, RAM, registers and I/O ports including serial ports. The I/O ports will be used to interface with the various switches, LED's, servo controls, speaker, radio modules and/or infrared modules.

The central processing unit 130 controls the flow of all information throughout the entire car device under the direction of the control program. The control program resides in the read only memory (ROM) 132.

The speech micro-controller 158 is a processor-based device, which includes its own speech ROM, program ROM, data RAM and clock circuitry. This type of speech micro-controller is commercially available in a single integrated chip with serial and parallel digital interfaces to control the operation of the micro-controller. The integrated chip can be custom-manufactured with prerecorded speech data that have been digitized, processed and synthesized. The speech data includes a plurality of prerecorded requests, responses and replies grouped and classified to match the operating states of the car device. Samples of these prerecorded speech data are shown in FIGS. 39, 40, 41, 42, 43, 44 & 45. Each of the prerecorded messages is addressable and can be selected by the CPU 130 for playback by simply activating the speech micro-controller and transmitting to it the code associated with the selected message. The micro-controller 158 is connected to a small speaker 188 approximately 2 inches in diameter, which is positioned in the middle portion of the roof the car device and perforations 194 are provided to permit sounds from the loudspeaker to issue from the car.

It should be clearly understood that the selection of a separate micro-controller 158 to provide prerecorded digital messages is for the purpose of describing the alternate embodiment and is not intended to limit the invention hereto. This micro-controller 158 can be combined with the main CPU 130 to provide an integrated singular controller for the car device which implements all functions provided by the device including speech generation. In such a configuration, both the digitized prerecorded speech data and control program will reside in the same ROM 132.

A plurality of dry cell batteries 210 for powering the car device are placed in a removable mounted battery pack positioned in a control box in the bottom of the car's frame. A pivoted door is provided for the player to access the batteries. The batteries 210 provide the main electrical energy necessary for the operation of the car device. An external jack 218 is being provided to connect the car to an external power source for charging the main batteries. A secondary battery 220 is placed in a separate compartment and provides a backup power for the memory subsystem, which holds the knowledge data base gained by the car device. This second battery is necessary to ensure that said data is not lost when the main battery 210 is totally drained or during the time when said primary battery is being disconnected or replaced. The connection of either the main 210 or secondary 220 battery is sufficient to provide electrical energy to the memory devices. A separate battery is provided for powering the remote control apparatus.

An on/off sliding switch 216 is provided to control the overall operation of the car device. This switch controls the connection of the main battery 210 to the power control circuitry 230 through the use of an electronic switching device integrated within the power control circuitry. Said power control circuitry 230 in turn controls the power connection to the various components of the car device. The power control circuitry is, also, connected to the CPU 130 via the data bus 150 and the address & control bus 152. This would enable the control program to trigger the switching device and turn the power "on" or "off" for the initiation or termination of play sessions. The power control circuitry 230 provides power interconnections to the central processing unit 130, the speech micro-controller 158, the radio receiver 168, the electric motor and other components of the car device.

A "forget" switch 180 is provided to enable the player to erase all information knowledge stored in the memory of the car device. Upon the activation of this switch, and subject to a successful identity check, the car will prompt the player to confirm if he or she would like to erase the knowledge database. The player may then confirm the forget function request by reactivating the switch within a predetermined period of time.

A game selector switch 182 is also provided to enable the player to select from a plurality of games provided by the car device. For the purpose of demonstrating this alternate embodiment, three games are being proposed. However, only under Game 1 the car is capable of memorizing the responses by the player. Accordingly, Game 1 represents the main intended operation for this car device. Under the setting for Game 1, the car device performs learning and acting tasks through interactions with the player using actual knowledge gained during past interactions. Game 2 is limited to the acting mode and can only be selected after the car device has gained sufficient knowledge related to previous interactions with the player. Under the setting for game 2, the control program selects an initial operating state for the play session. This initial operating state is randomly selected from operating states within level 3 or level 4 where the car device is most likely out of control. The player is then challenged to bring the car response under his or her control. This can be accomplished through a plurality of interactions with the car device provided that the player is consistent in setting forth "Alpha" responses. Game 3 is similar to game 2 except that an alternate knowledge data base is used to interact with the player. This alternate database is selected by the control program from a plurality of data bases stored in memory and, is not based on historical interactions with the player. Similar to Game 2, the player is challenged to bring the car under his or her control. Since the player is not familiar with the selected knowledge data base, he or she must guess as to which button should be activated in response to a particular interaction. Unlike Game 2, the selection of Game 3 is not limited by the amount of knowledge gained by the device. Both Games 2 & 3 will terminate if the player is successful in bringing the car under his or her control or if the player is unable to control the car device within a predetermined period of time or within a predetermined number of interactions.

With respect to the operation of the remote control car, and similar to the doll device, the car is controlled by the universal logic steps disclosed and illustrated in flow diagram from FIGS. 5 through 9 which are interconnect with each other at places shown in the various figures. As per the aforestated disclosure, this flow diagram and associated logic steps is generic and can be used to control a plurality of diverse toy devices including the doll device of the preferred embodiment, any stuffed animal or action figure with similar functionality's to said doll device as well as the car device of the alternate embodiment or any other toy device.

Upon the activation of the on/off switch 216, and similar to the doll device, a selection of an initial mode of operation will be made between the learning and acting modes. Further, an initial operating state will be selected to commence the playing session. The selection of the initial operating state is dependent on the game chosen by the player. As the player continues to interact with the car device, a new operating mode and/or a new operating state would be selected by following the logic steps of the universal flow diagram. Interactions with the car device consist of: motion commands by the player using the speed, direction and steering controls on the remote control device; verbalized requests by the car enacting a need or a predefined script; responses from the player by activating any of the plurality of switches on the remote control device; replies by the car device by way of motion and/or verbalized sentences or sound effects. The mechanical operation of the car device is controlled by the CPU 130 under the direction of the control program 132. Motion commands received via the radio 168 from the remote control unit 114 are digitized and processed by the micro-processor 130 before they are relayed to the servo controls 190 & 192 which operate the steering and driving mechanisms for the car device.

Figure 29:
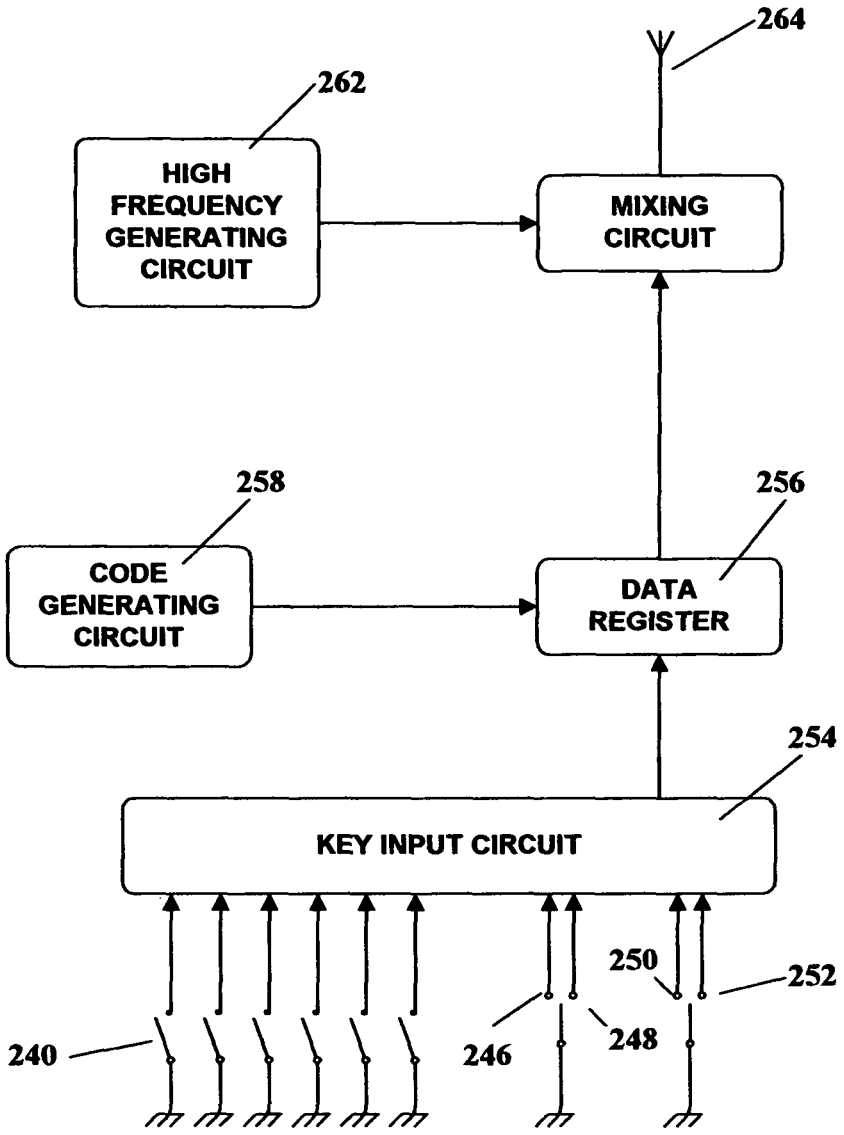
FIG. 29 is a block diagram of the remote control apparatus showing the preferred transmitter circuit according to the alternate embodiment of the invention.
Figure 30:
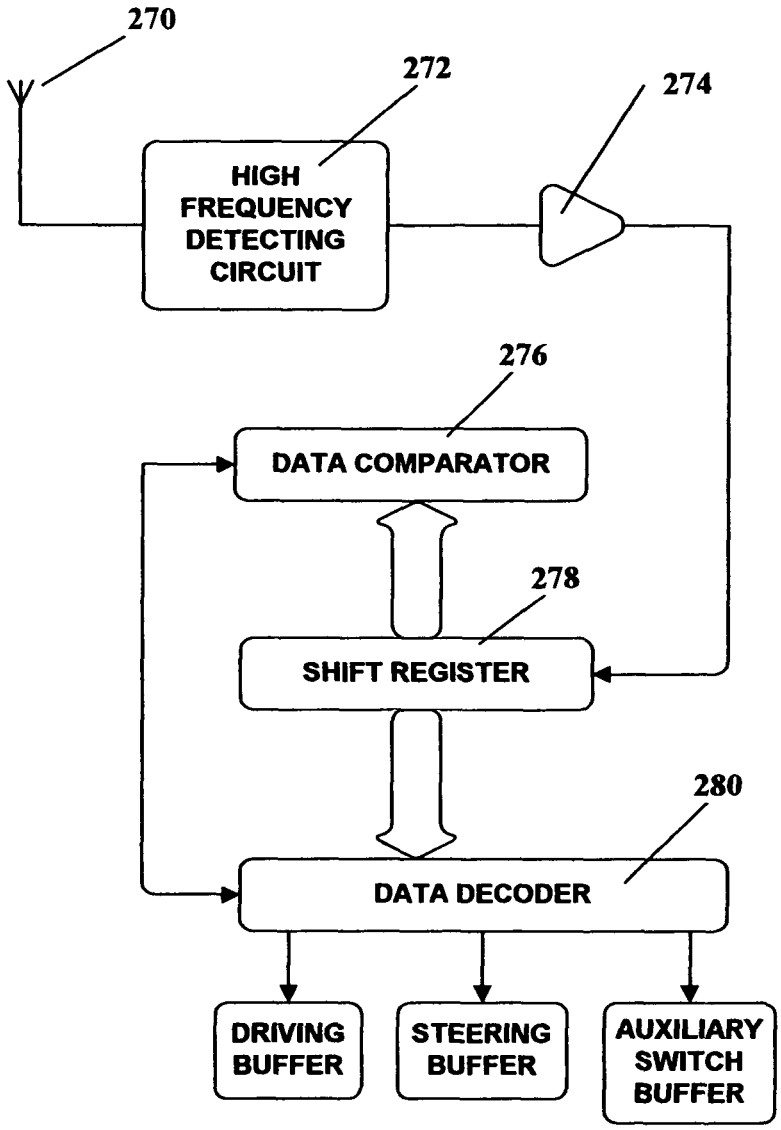
FIG. 30 is a block diagram of the preferred receiver circuit for the alternate embodiment.

FIG. 29 is a block diagram of the remote control apparatus showing a preferred transmitter circuit for the alternate embodiment of the present invention. The corresponding receiver circuit is shown in FIG. 30. The transmitter circuit of FIG. 29 is part of the portable remote control apparatus while the receiver circuit is part of the car embodiment. The combination of transmitter/receiver forms the radio control system for the play car device. While radio systems for remote control toy vehicles are conventional and known in this art, the preferred radio system for the present invention has the added functionality of transmitting the position of any auxiliary switch 240 activated by the player on the remote control apparatus 114. Accordingly, the radio system would transmit the position of the speed/direction control stick 232, the position of the steering control stick 234, and the position of any activated auxiliary switch 240.

One possible design for the radio system is to employ pulse position modulation and a bit detection method using a synchronous digital signal for a decoder or the like for either the motor, the steering control or any of the plurality of auxiliary switches provided on the remote control apparatus 114. Upon the movement of either the speed/direction 232 or the steering control 234 sticks of the transmitter unit, or upon the activation of any of the switches 240, the radio system generates control signals that will be transmitted to the receiver. Each of the control sticks 232 & 234 has two switches associated with it such that switches 246 and 248 are associated with the speed/direction control stick 232, and switches 250 and 252 are associated with the steering control stick 234. Any of these switches can be either in the "ON" or "OFF" state, however, switches 246 and 248 cannot both be in the "ON" state. Similarly, switches 250 and 252 cannot both be in the "ON" state. An "ON" state for switch 246 indicates that a request has been made by the player to rotate the motor in a forward drive direction thus requesting the car to move forward. Alternatively, an "ON" state for switch 248 indicates that a request has been made by the player to rotate the motor in a reverse drive direction thus requesting the car to move reverse. If both switches 246 and 248 are turned off, the car is requested to stop. The steering control stick 234 operates in a similar fashion.

A key input sub-circuit 254 is provided to detect the ON/OFF states of the control stick switches 232 & 234 as well as the status of the auxiliary switches 240. Said key input sub-circuit is connected to a data register 256 to which a code generating sub-circuit 258 is also connected. The output of the data register 256 is connected to a mixing sub-circuit 260, which also receives input from a high frequency generating sub-circuit 262 and acts as a modulator of the high frequency carrier. The output from the mixing sub-circuit 260 is fed to a transmitter antenna 264. The remote control apparatus also includes a battery with circuitry generating appropriate voltages in a conventional fashion, which are omitted from the figure for clarity.

The car receiver circuitry consists of a receiver antenna 270 preferably extending outside the car body, a receiver circuit for high-frequency amplification and detection 272, an amplifier circuit 274, a data comparator 276, a shift register 278, a data decoder 280 and three separate data buffers connected to the data bus 150 and address and control bus 152. The first of such data buffers 170 is associated with speed/direction commands, the second 172 is associated with steering commands and the third 174 is associated with the location or identity of an activated auxiliary switch 240.

Unlike conventional toy cars where speed/direction and/or steering signals received via the radio system are used to directly activate the circuits or servo mechanism connected to either the driving motor 190 or steering 192, the CPU 130 in the present invention controls the flow of the received signals to both the driving and steering circuits. Dependent on the operating state in effect, the CPU 130 under the direction of the control program 132 may forward the received signals as is to the motor and steering circuits 190 & 192, may substitute the received signals with new signals, or may ignore and discard of the received signals. Such actions by the CPU 130 are defined as the behavioral response of the car device to motion commands.

Said behavioral response of the car device to motion commands is classified into three main categories: loyal, defiant and independent. The selection between said three categories is dependent on the operating state in effect, the type of the last response and the confidence level of the last response. A proposed selection criterion is shown in FIGS. 35, 36, 37 & 38. Said selection criterion incorporates random elements to heighten the enjoyment of play. Under the "loyal" category, the car obeys the motion commands set forth by the player. This mode of car operation is normally invoked by operating states within levels 1 or 2, and is also invoked in level 3 and 4 when the confidence level of the last response is "0." The "loyal" behavioral response is implemented by the microprocessor through the generation of motion commands that are identical to the commands received from the player. Under the "defiant" category, the microprocessor ignores the motion commands received from the player and sets forth different motion commands that may contrast with the player's commands. This may be done on a one-on-one basis so that for each command received, the microprocessor may generate a different command, or in the alternative, the received command may be ignored or substituted by a plurality of different commands. For example if the player commands the car to go "left", the microprocessor may generate a "right" steering command. Another example would be the refusal of the car to move in response to a command from the player to move forward. This refusal could be silent or vocal. In a vocal response, the microprocessor will generate a vocalized statement in response to a motion command from the player. Under the "independent" category, the microprocessor may generate motion commands in reply to "Beta" responses by the player. Specific examples of behavioral responses to motion commands are shown in FIGS. 43, 44 & 45. It should be noted that the concept of behavioral response can be used as a standalone concept without the need to link the behavior of the car to the response by the player. For example, a toy car device can be built including random elements that control the selection of the car "mood," and the implementation of said loyal, defiant and independent movements.

In an alternate design to the remote control car, the same functionality may be provided using a toy car with either switches located on the body of the car, or a plurality of accessories that may be plugged in or connected to the car device.

In the alternate embodiment the generic classification of "Alpha" or "Beta" is implemented using the "Clever" or "Flimsy" classification. Also, the four generic operating states labeled "level 1", " level 2", " level 3" and "level 4" are being implemented as described in the universal flow diagram to form the basis for the operation of the car device. Accordingly, in the car device each generic operating state is realized using a plurality of specific operating states. For example, level 1 includes the "loyal," "obedient," "sympathetic" and "protective" operating states; level 2 includes the "guidance," "caution" and "opinion" operating states; level 3 includes the "critical," "independent" and "sarcastic" operating states and level 4 includes the "attacking," "defiant," "withdrawn" and "indifferent" operating states. As in the case of the doll device, random elements are used, as a factor, to select between specific operating states within the same generic state.

Similar to the doll-to-doll interaction feature, car-to-car interaction requires the incorporation of an infra-red module and a program segment that executes when two cars are placed at close proximity to each other. A plurality of car-to-car interactions is stored within the car device and is based on the mood of each of the two cars. The interaction is in the form of verbal conversation related to how each of the two cars "feel" based on its current mood. The interaction may also include car movements provided that such movements will not result in a loss of communication between the two cars. Accordingly, and if there are ten (10) programmed moods for each car, then there is a potential for one hundred (100) possible different conversations that may take place between two cars. The script for each conversation is stored in the ROM of the speech microprocessor 158, and selected based on information stored in RAM 134 related to the current moods of the two cars. Upon receiving an infrared signal, each car will transmit its current mood to the other car. A predefined process will select which of the two cars will initiate the conversation, and which car will respond. Accordingly, the first part of the script for each conversation may vary depending on which car is selected to initiate the interaction. Upon completion of a sentence that is part of a script, each car will transmit a signal to the other car to start its response or reply. Such a process will continue until the end of the interaction. Upon completion of a car-to-car interaction, no further interaction between the two cars will take place until the interruption and re-establishment of infrared communications between the two cars. An example of car-to-car interaction is shown in FIG. 49.

As will be understood by those skilled in the art, many different embodiments may be based on the generic flow charts disclosed in FIG. 5 through FIG. 9. The use of a doll device or a toy car device is simply for demonstration purposes only. Any play device such as a toy animal, a fictitious or historic figure, an action vehicle of any kind or the like can be used. Also, different generic flow charts may be based on the general concept presented in this invention. These flow charts are only one example of how to implement the new general concept of personalizing a play or toy device by making it adaptable to previous interactions between the player and the device. Furthermore, many programs may be utilized to implement the flow charts disclosed in FIG. 5 through FIG. 12. Obviously these programs will vary from one another in some degree. However, it is well within the skill of the computer programmer to provide particular programs for implementing each of the steps of the flow charts disclosed herein. It is also to be understood that the foregoing detailed description has been given for clearness of understanding only and is intended to be exemplary of the invention while not limiting the invention to the exact embodiment shown. Obviously certain subsets, modifications, simplifications, variations and improvements will occur to those skilled in the art upon reading the foregoing. It is, therefore, to be understood that all such modifications, simplifications, variations and improvements have been deleted herein for the sake of conciseness and readability, but are properly within the scope and spirit of the following claims.

The invention claimed is:

1. An interactive play device for interacting between the device and a user, wherein the device gains knowledge from a plurality of past interactions with the user, comprising:

means for providing a plurality of interactions, a plurality of input control mechanisms, memory means for storing information related to user's interactions with the device, means for deriving knowledge information pertaining to the user from said plurality of past interactions, including at least one of user's responses to interactions by the device, pattern of user's interactions with the device, user's preferences in interacting with the device, user's skill in interacting with the device, and personal information pertaining to the user, means for operating the device in a plurality of states, wherein the device provides at least two distinct interactions during at least one of said plurality of operating states, and control means responsive to said plurality of input control mechanisms and which employs said knowledge information for the user to transform the device from an initial operating state to a desired operating state.

2. An interactive play device as recited in claim 1 further comprising a housing.

3. An interactive play device as recited in claim 2 wherein said housing is in the form of a doll, animal, action figure, story or fairytale character, historic character, monster character, alien or extraterrestrial character, heroic character, religious character, movie or television character, vehicle, android or cartoon character.

4. An interactive play device as recited in claim 1 further comprising means for modifying stored information related to user interactions.

5. An interactive play device as recited in claim 2, further comprising a screen that provides visual communication.

6. An interactive play device as recited in claim 1, wherein said means to transform the device from an initial operating state to a desired operating state includes random element.

7. An interactive play device as recited in claim 1 wherein said plurality of input control mechanisms includes at least one of a switch, a computer keyboard, touch screen controls and a computer mouse with associated controls.

8. An interactive play device as recited in claim 2 wherein said plurality of input control mechanisms includes at least one of a switch located on the device, a switch located on a remote control apparatus, a touch control switch located on a remote control apparatus, a sensor, sound detector, motion detector, a speech recognition module, and accessories that could be plugged into the device.

9. An interactive play device as recited in claim 1, wherein in at least one of said plurality of states the device mimics human behavior.

10. An interactive play device as recited in claim 9, wherein said at least one of said plurality of states during which the device mimics human behavior includes at least one of happy, sad, angry, scared and surprised states.

11. An interactive play device for interacting between the device and a user, wherein the device gains knowledge from a plurality of past interactions with the user, and can operate in a plurality of states, comprising:

a housing, a microprocessor with a non-transitory computer-readable medium encoded with a computer program to control the operation of the play device, including controlling the device to operate in a plurality of states, a computer program segment that controls a plurality of interactions with the user, wherein the device provides at least two distinct interactions in at least one of said plurality of operating states, a plurality of input control mechanisms for the user to interact with the device, computer memory to store data related to user's interactions with the device, a computer program segment that processes said stored data to establish knowledge information related to how the user interacted with the device during said plurality of past interactions, including at least one of user's responses to interactions by the device, pattern of user's interactions with the device, user's preferences in interacting with the device, user's skill in interacting with the device, and personal information pertaining to the user, and a computer program segment, responsive to user's activations of said plurality of input control mechanisms, and which employs said knowledge information to transform the device from a current operating state to a different operating state.

12. An interactive play device as recited in claim 11 wherein said plurality of interactions include visual communications provided by light emitting means.

13. An interactive play device as recited in claim 11 wherein said plurality of interactions includes at least one aural interaction.

14. An interactive play device as recited in claim 11 further comprising a screen that provides visual interactions.

15. An interactive play device as recited in claim 11 wherein said plurality of interactions includes a reply by the device that is responsive to the activation of an input control mechanism.

16. An interactive play device as recited in claim 11, wherein said user's interactions with the device include at least one of the activation of a switch located on the device, the activation of a touch control switch located on a remote apparatus that communicates with the device, the activation of a sensor, the activation of speech recognition module, the activation of a sound detector, the activation of a motion detector and plugging in an accessory into the device.

17. An interactive play device as recited in claim 11 wherein said housing is in the form of a doll, animal, action figure, story or fairytale character, historic character, monster character, alien or extraterrestrial character, heroic character, religious character, movie or television character, a military character, a vehicle, an android or cartoon character.

18. An interactive play device as recited in claim 11, wherein in at least one of said plurality of states the device mimics human behavior.

19. An interactive play device as recited in claim 18, wherein said at least one of said plurality of states during which the device mimics human behavior includes at least one of happy, sad, angry, afraid and surprised states.

20. An interactive play device for interacting between the device and a user, wherein the device gains knowledge from a plurality of interactions with the user, comprising:

a housing, a microprocessor with a non-transitory computer-readable medium encoded with a computer program to control the operation of the play device, including enabling the device to operate in a plurality of states, a computer program segment that generates a plurality of interactions, wherein the device provides at least two distinct interactions in at least one of said plurality of operating states, at least one of a push button, switch, pressure switch, touch control switch, sensor, voice activated switch, speech recognition module, sound activated sensor, a motion detector, a touch control located on a remote apparatus, a sensor located on a remote apparatus, a push button located on a remote control apparatus, and an accessory that can be plugged into the device to enable the user to interact with the device, computer memory to store information related to said plurality of user's interactions with the device, a computer program segment that employs said stored information to establish knowledge information that includes at least one of user's responses to interactions by the device, pattern of user's interactions, user's preferences in interacting with the device, user's skill in interacting with the device, and personal information pertaining to the user, and a computer program segment, responsive to user's interaction with the device and which uses said knowledge information to transform the device from a current operating state to a different operating state.

21. An interactive play device as recited in claim 20 wherein said plurality of interactions includes visual interactions.

22. An interactive play device as recited in claim 20 wherein said plurality of interactions includes sound effects.

23. An interactive play device as recited in claim 20 wherein said housing is in the form of a doll, animal, action figure, story or fairytale character, historic character, monster character, alien or extraterrestrial character, heroic character, religious character, movie or television character, or cartoon character, a vehicle or an android.

24. An interactive play device as recited in claim 20, wherein during at least one of said plurality of operating states, the device operates autonomously independent of the activation of said plurality of input control mechanisms.

25. An interactive play device as recited in claim 20 further comprising means for communicating with a similar device.

26. An interactive play device as recited in claim 25, further comprising a control program segment to generate a plurality of interactions for providing interactive effects with a similar device.

27. An interactive play device as recited in claim 20, wherein in at least one of said plurality of states the device mimics human behavior.

28. An interactive play device as recited in claim 27, wherein said at least one of said plurality of states during which the device mimics human behavior includes at least one of happy, sad, afraid, angry and surprised states.

29. An interactive play device for interacting between the device and a user, wherein the device gains knowledge from a plurality of past interactions with the user, and can operate in a plurality of states, and wherein the device provides one or more interactions in at least one of said plurality of states comprising:

a housing, a microprocessor with a non-transitory computer-readable medium encoded with a computer program to control the operation of the play device, a program segment that controls a plurality of interactions with the user, at least one of a push button, switch, pressure switch, touch control switch, sensor, voice activated switch, a sound detector, a speech recognition module, a motion detector, a push button located on a remote control apparatus, at least one of a mechanical switch, a touch control switch, a sensor and a detector located on a remote apparatus that communicates with the device, and an accessory that can be plugged into the device to enable the user to interact with the device, computer memory to store information related to user's interactions with the device, a computer program segment that establishes knowledge information on how the user interacted with the device during said plurality of past interactions, including at least one of user's responses to interactions, pattern of user's interactions, user's preferences in responding to interactions by the device, user's skill in interacting with the device, and personal information pertaining to the user, and a computer program segment, responsive to said user's interactions to transform the device from a current operating state to a different operating state.

30. An interactive play device as recited in claim 29 wherein in at least one of said plurality of states, the device mimics human behavior and operates in at least one of happy, sad, afraid, angry and surprised states.

31. An interactive play device as recited in claim 29 wherein said housing is in the form of a doll, animal, action figure, story or fairytale character, historic character, monster character, alien or extraterrestrial character, heroic character, religious character, movie or television character, vehicle, android or cartoon character.

32. In an interactive play device for interacting between the device and a user, wherein the device includes a microprocessor with a computer-readable medium encoded with a computer program to control the operation of the device, wherein the device employs a plurality of input control mechanisms for the user to interact with the device, wherein the device includes memory to store information, wherein the device gains knowledge from a plurality of past interactions with the user, and can operate in a plurality of states, and wherein the device provides two or more distinct interactions during at least one of said plurality of states, a method for controlling the device having the steps of:

generating a plurality of interactions;

storing information in device memory related to user's interactions;

employing said stored information to establish knowledge information that includes at least one of user's responses to interactions by the device, pattern of user's interactions, user's preferences in responding to interactions by the device, user's skill in interacting with the device, and personal information pertaining to the user; and transforming the device from a current operating state to a different operating state based on said knowledge information and in response to user's activations of said input control mechanisms.

33. An interactive play device for interacting between the device and a user, wherein the device gains knowledge from a plurality of previous interactions with the user, comprising:

a housing, a microprocessor with a non-transitory computer-readable medium encoded with a computer program to control the operation of the play device, including enabling the device to operate in a plurality of states, a computer program segment that provides a plurality of interactions, wherein the device provides at least two distinct interactions in at least one of said plurality of operating states, and wherein in at least one of said operating states the device mimics human like behavior, a plurality of input control mechanisms that include at least one of a push button, switch, pressure switch, touch control switch, sensor, voice activated switch, speech recognition module, sound activated sensor, a motion detector, a touch control located on a remote apparatus, a sensor located on a remote apparatus, a push button located on a remote control apparatus, and an accessory that can be plugged into the device, computer memory to store information related to user's interactions with the device, a computer program segment that employs said stored information to establish knowledge information on how the user interacted with the device during said plurality of past interactions, wherein said knowledge information includes at least one of user's responses to interactions by the device, pattern of user's interactions, user's preferences in interacting with the device, user's skill in interacting with the device, and personal information pertaining to the user, and a computer program segment, responsive to user's activations of said plurality of input control mechanisms, and which uses said knowledge information to transform the device from a current operating state to a different operating state, wherein said different operating state includes at least one new interaction with the user.

34. In an interactive play device for interacting between the device and a user, wherein the device includes a microprocessor with a computer-readable medium encoded with a computer program to control the operation of the device, wherein the device employs a plurality of input control mechanisms for the user to interact with the device, wherein the device includes memory to store information, wherein the device gains knowledge from a plurality of past interactions with the user, and can operate in a plurality of states, and wherein the device provides two or more distinct interactions during at least one of said plurality of states, a method for controlling the device having the steps of:

providing a plurality of interactions with the user;

storing information in device memory related to user's interactions;

employing said stored information to establish knowledge information that includes at least one of user's responses to interactions by the device, pattern of user's interactions, user's preferences in responding to interactions by the device, user's skill in interacting with the device, and personal information pertaining to the user; and transforming the device from a current operating state to a different operating state based on said knowledge information and in response to user's activations of said input control mechanisms, wherein said different operating state provides at least one additional interaction with the user.

35. An interactive play device for interacting between the device and a user, wherein the device gains knowledge from a plurality of previous interactions with the user, comprising:

a housing, a microprocessor with a non-transitory computer-readable medium encoded with a computer program to control the operation of the play device, including enabling the device to operate in a plurality of states, at least one of a push button, switch, pressure switch, touch control switch, sensor, voice activated switch, speech recognition module, sound activated sensor, a motion detector, a touch control located on a remote apparatus, a sensor located on a remote apparatus, a push button located on a remote control apparatus, and an accessory that can be plugged into the device to enable the user to interact with the device, a computer program segment that provides a plurality of interactions, wherein the device provides at least one interaction that mimics human behavior in at least one of said plurality of operating states, and wherein the device provides an interaction that is independent of user's interaction during at least one of said operating states, computer memory to store information related to user's interactions with the device, a computer program segment that employs said stored information to establish knowledge information on how the user interacted with the device during said plurality of past interactions, wherein said knowledge information includes at least one of user's responses to interactions by the device, pattern of user's interactions, user's preferences in interacting with the device, user's skill in interacting with the device, and personal information pertaining to the user, and a computer program segment, responsive to user's activations of said plurality of input control mechanisms, and which uses said knowledge information to transform the device from a current operating state to a different operating state, wherein said different operating state includes at least one new interaction with the user.

* * * * *